US009338561B2

(12) United States Patent
Gran et al.

(10) Patent No.: US 9,338,561 B2
(45) Date of Patent: May 10, 2016

(54) HEARING AID WITH IMPROVED LOCALIZATION

(71) Applicant: GN ReSound A/S, Ballerup (DK)

(72) Inventors: Karl-Fredrik Johan Gran, Malmö (SE); Guilin Ma, Lybgby (DK)

(73) Assignee: GN ReSound A/S, Ballerup (DK)

( * ) Notice: Subject to any disclaimer, the term of this patent is extended or adjusted under 35 U.S.C. 154(b) by 92 days.

(21) Appl. No.: 13/872,720

(22) Filed: Apr. 29, 2013

(65) Prior Publication Data

US 2014/0185847 A1 Jul. 3, 2014

(30) Foreign Application Priority Data

Dec. 28, 2012 (DK) ..... 2012 70832
Dec. 28, 2012 (EP) ..... 12199720

(51) Int. Cl.
*H04R 5/02* (2006.01)
*H04R 25/00* (2006.01)

(52) U.S. Cl.
CPC ..... *H04R 25/407* (2013.01); *H04R 25/405* (2013.01); *H04S 2420/01* (2013.01)

(58) Field of Classification Search
CPC ..... H04S 2420/01
See application file for complete search history.

(56) References Cited

U.S. PATENT DOCUMENTS 5,325,436 A * 6/1994 Soli et al. ..... 381/313
5,325,463 A 6/1994 Murata et al.

(Continued)

FOREIGN PATENT DOCUMENTS

EP 1 414 268 4/2004
EP 1 594 344 11/2005

(Continued)

OTHER PUBLICATIONS

Notice of Allowance and Fees Due dated Sep. 16, 2013 for U.S. Appl. No. 13/352,133, 6 pages.

(Continued)

*Primary Examiner* — Duc Nguyen
*Assistant Examiner* — Taunya McCarty
(74) *Attorney, Agent, or Firm* — Vista IP Law Group, LLP

(57) ABSTRACT

A method of determining parameters of a BTE hearing aid having at least one ITE microphone and at least one BTE microphone, the method includes: determining Head-Related Transfer functions $HRTF_l(f)$; determining a hearing aid related transfer function $H_{l,i}^{ITEC}(f)$ of a $i^{th}$ microphone of the at least one ITE microphone for direction l; determining a hearing aid related transfer functions $H_{l,j}^{BTEC}(f)$ of a $j^{th}$ microphone of the at least one BTE microphone; determining transfer functions $G_i^{IEC}(f)$ of a $i^{th}$ cue filter of at least one cue filter filtering audio sound signals of the at least one ITE microphone; and determining transfer functions $G_j^{BTEC}(f)$ of a $j^{th}$ cue filter of the at least one cue filter filtering audio sound signals of the at least one BTE microphone; wherein the transfer functions $G_i^{IEC}(f)$ and the transfer functions $G_j^{BTEC}(f)$ are determined using a processing unit based on equation:

$$\min_{G_i^{IEC}(f),G_j^{BTEC}(f)} \sum_{l=0}^{L-1} W(l) \| W(f)HRTF_l(f) - \sum_i G_i^{IEC}(f) H_{l,i}^{IEC}(f) - \sum_j G_j^{BTEC}(f) H_{l,j}^{BTEC}(f)) \|^p.$$

28 Claims, 8 Drawing Sheets

(56) References Cited

U.S. PATENT DOCUMENTS

| | | | | |
|---|---|---|---|---|
| 5,473,702 | A | 12/1995 | Yoshida et al. | |
| 7,313,241 | B2 | 12/2007 | Hamacher et al. | |
| 8,208,642 | B2 | 6/2012 | Edwards | |
| 2001/0002930 | A1 | 6/2001 | Kates | |
| 2004/0136541 | A1 | 7/2004 | Hamacher et al. | |
| 2007/0086602 | A1 | 4/2007 | Petersen et al. | |
| 2007/0183603 | A1 * | 8/2007 | Jin et al. | 381/17 |
| 2009/0067651 | A1 | 3/2009 | Klinkby et al. | |
| 2009/0097681 | A1 | 4/2009 | Puria et al. | |
| 2009/0202091 | A1 | 8/2009 | Pedersen et al. | |
| 2009/0262964 | A1 | 10/2009 | Havenith et al. | |
| 2010/0092016 | A1 | 4/2010 | Iwano et al. | |
| 2010/0303267 | A1 | 12/2010 | Pedersen et al. | |
| 2012/0308019 | A1 | 12/2012 | Edwards | |
| 2012/0308057 | A1 | 12/2012 | Edwards et al. | |
| 2013/0064403 | A1 | 3/2013 | Hasler et al. | |

FOREIGN PATENT DOCUMENTS

| | | | |
|---|---|---|---|
| EP | 2 088 802 | | 8/2009 |
| EP | 2 124 483 | | 11/2009 |
| EP | 2 391 145 | | 11/2011 |
| EP | 2 584 794 | A1 | 4/2013 |
| EP | 2 611 218 | | 7/2013 |
| WO | WO 0225996 | A1 * | 3/2002 |
| WO | 2006/037156 | | 4/2006 |
| WO | 2006/042540 | A1 | 4/2006 |
| WO | 2008/010716 | A2 | 1/2008 |
| WO | WO 2009/049320 | | 4/2009 |
| WO | 2011/098153 | A1 | 8/2011 |

OTHER PUBLICATIONS

Second Technical Examination and Intention to Grant dated Feb. 27, 2014 for DK Patent Application No. PA 2012 70836.
First Technical Examination Search Report dated Nov. 18, 2103 for related Danish Patent Application No. PA 2013 70273, 4 pages.
Extended European Search Report dated Aug. 9, 2013 for EP Patent Application No. 13168718.8.
Non-final Office Action dated Jul. 28, 2014 for U.S. Appl. No. 13/901,386.
Non-final Office Action dated Sep. 11, 2014 for U.S. Appl. No. 13/872,590.
Non-Final Office Action dated Sep. 15, 2014 for U.S. Appl. No. 13/872,459.
First Technical Examination and Search Report dated Aug. 28, 2014, for related DK Patent Application No. PA 2014 70178, 6 pages.
Extended European Search Report dated Jun. 21, 2012 for EP Patent App. No. 11196089.4.
First Office Action dated Jun. 20, 2012 for DK Patent App. No. PA 2011 70759.
Second Technical Examination, Intention to Grant dated Jan. 18, 2013 for DK Patent App. No. PA 2011 70759.
Notice of Allowance & Fees Due dated Apr. 16, 2013 for U.S. Appl. No. 13/352,133.
Extended European Search Report dated May 2, 2013 for EP Patent App. No. 12197705.2.
Extended European Search Report dated Jun. 5, 2013 for EP Patent App. No. 12199761.3.
Extended European Search Report dated May 27, 2013 for EP Patent App. No. 12199744.9.
First Technical Examination and Search Report dated May 31, 2013 for DK Patent Application No. PA 2012 70833.
First Technical Examination and Search Report dated Jun. 4, 2013 for DK Patent Application No. PA 2012 70832.
First Technical Examination and Search Report dated Aug. 12, 2013 for DK Patent Application No. PA 2012 70836.
Extended European Search Report dated May 31, 2013 for EP Patent Application No. 12199720.9.
Second Technical Examination—Intention to Grant dated Apr. 22, 2014 for related DK Patent Application No. PA 2012 70832, 2 pages.
Final Office Action dated Dec. 10, 2014 for U.S. Appl. No. 13/901,386.
Notification of Reason for Rejection dated Nov. 11, 2014 for related Japanese Patent Application No. 2013-266879, 4 pages.
English Translation of Notification of Reason for Rejection dated Nov. 5, 2013 for related JP Patent Application No. 2012-281443, 4 pages.
Extended European Search Report dated Jan. 20, 2015 for related EP Patent Application No. 14163573.0, 8 pages.
Notice of Allowance and Fees Due dated Feb. 4, 2015 for U.S. Appl. No. 13/872,459.
Notice of Allowance and Fees Due Feb. 3, 2015 for U.S. Appl. No. 13/872,590.
Notice of Allowance and Fees Due dated Mar. 31, 2015 for U.S. Appl. No. 13/901,386.
Notice of Allowance and Fees Due dated Apr. 15, 2015 for U.S. Appl. No. 13/872,459.
Notice of Allowance and Fees Due dated Apr. 28, 2015 for U.S. Appl. No. 13/872,590.
Non-final Office Action dated Aug. 10, 2015 for related U.S. Appl. No. 14/252,631.
Corrected Notice of Allowability dated Aug. 28, 2015 for related U.S. Appl. No. 13/872,459.
Corrected Notice of Allowability dated Aug. 28, 2015 for related U.S. Appl. No. 13/872,590.
Second Technical Examination dated Mar. 20, 2015 for related Danish Patent Application No. PA 2014 70178, 3 pages.
Third Technical Examination dated Apr. 17, 2015 for related Danish Patent Application No. PA 2014 70178, 2 pages.
Fourth Technical Examination—Intention to Grant dated May 18, 2015 for related Danish Patent Application No. PA 2014 70178, 2 pages.
First Office Action dated Oct. 14, 2015 for related Chinese Patent Application No. 201210593011.6, 10 pages.

* cited by examiner

HEARING AID WITH IMPROVED LOCALIZATION

RELATED APPLICATION DATA

This application claims priority to and the benefit of Danish Patent Application No. PA 2012 70832, filed on Dec. 28, 2012, and European Patent Application No. 12199720.9, filed on Dec. 28, 2012. The disclosures of all of the above applications are expressly incorporated by reference in their entireties herein.

FIELD

A new hearing aid is provided with improved localization of sound sources with relation to the wearer of the hearing aid.

BACKGROUND

Hearing aid users have been reported to have poorer ability to localize sound sources when wearing their hearing aids than without their hearing aids. This represents a serious problem for the mild-to-moderate hearing impaired population.

Furthermore, hearing aids typically reproduce sound in such a way that the user perceives sound sources to be localized inside the head. The sound is said to be internalized rather than being externalized. A common complaint for hearing aid users when referring to the "hearing speech in noise problem" is that it is very hard to follow anything that is being said even though the signal to noise ratio (SNR) should be sufficient to provide the required speech intelligibility. A significant contributor to this fact is that the hearing aid reproduces an internalized sound field. This adds to the cognitive loading of the hearing aid user and may result in listening fatigue and ultimately that the user removes the hearing aid(s).

Thus, there is a need for a new hearing aid with improved localization of sound sources, i.e. the new hearing aid preserves information of the directions and distances of respective sound sources in the sound environment with relation to the orientation of the head of the wearer of the hearing aid.

Human beings detect and localize sound sources in three-dimensional space by means of the human binaural sound localization capability.

The input to the hearing consists of two signals, namely the sound pressures at each of the eardrums, in the following termed the binaural sound signals. Thus, if sound pressures at the eardrums that would have been generated by a given spatial sound field are accurately reproduced at the eardrums, the human auditory system will not be able to distinguish the reproduced sound from the actual sound generated by the spatial sound field itself.

It is not fully known how the human auditory system extracts information about distance and direction to a sound source, but it is known that the human auditory system uses a number of cues in this determination. Among the cues are spectral cues, reverberation cues, interaural time differences (ITD), interaural phase differences (IPD) and interaural level differences (ILD).

The transmission of a sound wave from a sound source positioned at a given direction and distance in relation to the left and right ears of the listener is described in terms of two transfer functions, one for the left ear and one for the right ear, that include any linear distortion, such as coloration, interaural time differences and interaural spectral differences. Such a set of two transfer functions, one for the left ear and one for the right ear, is called a Head-Related Transfer Function (HRTF). Each transfer function of the HRTF is defined as the ratio between a sound pressure p generated by a plane wave at a specific point in or close to the appertaining ear canal ($p_L$ in the left ear canal and $p_R$ in the right ear canal) in relation to a reference. The reference traditionally chosen is the sound pressure $p_I$ that would have been generated by a plane wave at a position right in the middle of the head with the listener absent.

The HRTF contains all information relating to the sound transmission to the ears of the listener, including diffraction around the head, reflections from shoulders, reflections in the ear canal, etc., and therefore, the HRTF varies from individual to individual.

In the following, one of the transfer functions of the HRTF will also be termed the HRTF for convenience.

The hearing aid related transfer function is defined similar to a HRTF, namely as the ratio between a sound pressure p generated by the hearing aid at a specific point in the appertaining ear canal in response to a plane wave and a reference. The reference traditionally chosen is the sound pressure $p_I$ that would have been generated by a plane wave at a position right in the middle of the head with the listener absent.

The HRTF changes with direction and distance of the sound source in relation to the ears of the listener. It is possible to measure the HRTF for any direction and distance and simulate the HRTF, e.g. electronically, e.g. by filters. If such filters are inserted in the signal path between a playback unit, such as a tape recorder, and headphones used by a listener, the listener will achieve the perception that the sounds generated by the headphones originate from a sound source positioned at the distance and in the direction as defined by the transfer functions of the filters simulating the HRTF in question, because of the true reproduction of the sound pressures in the ears.

Binaural processing by the brain, when interpreting the spatially encoded information, results in several positive effects, namely better signal-to-noise ratio (SNR); direction of arrival (DOA) estimation; depth/distance perception and synergy between the visual and auditory systems.

The complex shape of the ear is a major contributor to the individual spatial-spectral cues (ITD, ILD and spectral cues) of a listener. Devices which pick up sound behind the ear will, hence, be at a disadvantage in reproducing the HRTF since much of the spectral detail will be lost or heavily distorted.

This is exemplified in FIGS. 1 and 2 where the angular frequency spectrum of an open ear, i.e. non-occluded, measurement is shown in FIG. 1 for comparison with FIG. 2 showing the corresponding measurement on the front microphone on a behind the ear device (BTE) using the same ear. The open ear spectrum shown in FIG. 1 is rich in detail whereas the BTE result shown in FIG. 2 is much more blurred and much of the spectral detail is lost.

SUMMARY

It is therefore desirable to position a microphone of the hearing aid at a position with relation to a user wearing the hearing aid, in which spatial cues of sounds arriving at the user is preserved. It is for example advantageous to position a microphone in the outer ear of the user in front of the pinna, for example at the entrance to the ear canal; or, inside the ear canal, in order to preserve spatial cues of sounds arriving at the ear to a much larger extent than what is possible with a microphone positioned behind the ear. A microphone positioned in front of the pinna below the triangular fossa has also proven advantageous with relation to preservation of spatial cues.

Positioning of a microphone at the entrance to the ear canal or inside the ear canal leads to the problem that the microphone is moved close to the sound emitting device of the hearing aid, whereby the risk of feedback generation is increased, which in turn limits the maximum stable gain which can be prescribed with the hearing aid.

The standard way of solving this problem is to completely seal off the ear canal using a custom mould. This, however, introduces the occlusion effect as well as comfort issues with respect to moisture and heat.

For comparison, the maximum stable gain of a BTE hearing aid with front and rear microphones positioned behind the ear, and an In-The-Ear (ITE) hearing aid with an open fitted microphone positioned in the ear canal is shown in FIG. 3. It can be seen that the ITE hearing aid has much lower maximum stable gain (MSG) than the front and rear BTE microphones for nearly all frequencies.

In the new hearing aid, output signals of an arbitrary configuration of microphones undergo signal processing in such a way that spatial cues are preserved and conveyed to the user of the hearing aid. The output signals are filtered with filters that are configured to preserve spatial cues.

The new hearing aid may provide improved localization to the user by providing, in addition to conventionally positioned microphones as in a BTE hearing aid, at least one ITE microphone intended to be positioned in the outer ear of the user in front of the pinna, e.g. at the entrance to the ear canal or immediately below the triangular fossa; or, inside the ear canal, when in use, in order to record sound arriving at the ear of the user and containing the desired spatial information relating to localization of sound sources in the sound environment.

The processor of the new hearing aid combines an audio signal of the at least one ITE microphone residing in the outer ear of the user with the microphone signal(s) of the conventionally positioned microphone(s) of the hearing aid in such a way that spatial cues are preserved. An audio signal of the at least one ITE microphone may be formed as a weighted sum of the output signals of each microphone of the at least one ITE microphone. Other forms of signal processing may be included in the formation of the audio signal of the at least one ITE microphone.

Thus, a new hearing aid is provided, comprising a BTE hearing aid housing configured to be worn behind the pinna of a user, at least one BTE sound input transducer, such as an omni-directional microphone, a directional microphone, a transducer for an implantable hearing aid, a telecoil, a receiver of a digital audio datastream, etc., accommodated in the BTE hearing aid housing, each of which is configured for conversion of acoustic sound into a respective audio signal, an ITE microphone housing configured to be positioned in the outer ear of the user for fastening and retaining in its intended position at least one ITE microphone accommodated in the ITE microphone housing, each of which is configured for conversion of acoustic sound into a respective audio signal, at least one cue filter, each of which having an input that is provided with an output signal from a respective one of the at least one BTE sound input transducer and at least one ITE microphone, a processor configured to generate a hearing loss compensated output signal based on a combination of the filtered audio signals output by the at least one cue filter, an output transducer for conversion of the hearing loss compensated output signal to an auditory output signal that can be received by the human auditory system, and wherein the processor is further configured for processing the output signals of the at least one ITE microphone and the at least one BTE sound input transducer in such a way that the hearing loss compensated output signal substantially preserves spatial cues, such as the spatial cues recorded by the at least one ITE microphone, or recorded by a combination of the at least one ITE microphone and the at least one BTE sound input transducer.

The hearing aid may further have a sound signal transmission member for transmission of a signal representing sound from a sound output in the BTE hearing aid housing at a first end of the sound signal transmission member to the ear canal of the user at a second end of the sound signal transmission member, an earpiece configured to be inserted in the ear canal of the user for fastening and retaining the sound signal transmission member in its intended position in the ear canal of the user.

The new hearing aid may be a multi-channel hearing aid in which signals to be processed are divided into a plurality of frequency channels, and wherein signals are processed individually in each of the frequency channels. Possible adaptive feedback cancellation circuitry may also be divided into the plurality of frequency channels; or, the adaptive feedback cancellation circuitry may still operate in the entire frequency range; or, may be divided into other frequency channels, typically fewer frequency channels, than the other circuitry is divided into.

The processor may be configured for processing the output signals of the at least one ITE microphone and the at least one BTE sound input transducer in such a way that the hearing loss compensated output signal substantially preserves spatial cues in a selected frequency band.

The selected frequency band may comprise one or more of the frequency channels, or all of the frequency channels. The selected frequency band may be fragmented, i.e. the selected frequency band need not comprise consecutive frequency channels.

The plurality of frequency channels may include warped frequency channels, for example all of the frequency channels may be warped frequency channels.

Outside the selected frequency band, the at least one ITE microphone may be connected conventionally as an input source to the processor of the hearing aid and may cooperate with the processor of the hearing aid in a well-known way.

In this way, the at least one ITE microphone supplies the input to the hearing aid at frequencies where the hearing aid is capable of supplying the desired gain with this configuration.

In the selected frequency band, wherein the hearing aid cannot supply the desired gain with this configuration, the microphones of BTE hearing aid housing are included in the signal processing as disclosed above. In this way, the gain can be increased while simultaneously maintain the spatial information about the sound environment provided by the at least one ITE microphone.

The hearing aid may for example comprise a first filter connected between the processor input and the at least one ITE microphone, and a second complementary filter connected between the processor input and a combined output of the at least one BTE sound input transducer, the filters passing and blocking frequencies in complementary frequency bands so that one of the at least one ITE microphone and the combined output of at least one BTE sound input transducer constitutes the main part of the input signal supplied to the processor input in one frequency band, and the other one of the at least one ITE microphone and the combined output of at least one BTE sound input transducer constitutes the main part of the input signal supplied to the processor input in the complementary frequency band.

In this way, the at least one ITE microphone may be used as the sole input source to the processor in a frequency band wherein the required gain for hearing loss compensation can be applied to the output signal of the at least one ITE microphone. Outside this frequency band, the combined output signal of the at least one BTE sound input transducer is applied to the processor for provision of the required gain.

Throughout the present disclosure, the "output signals of the at least one ITE microphone" may be used to identify any analogue or digital signal forming part of the signal path from the output of the at least one ITE microphone to an input of the processor, including pre-processed output signals of the at least one ITE microphone.

Likewise, the "output signals of the at least one BTE sound input transducer" may be used to identify any analogue or digital signal forming part of the signal path from the at least one BTE sound input transducer to an input of the processor, including pre-processed output signals of the at least one BTE sound input transducer.

Preferably, the at least one ITE microphone is positioned so that the output signal of the at least one ITE microphone generated in response to the incoming sound has a transfer function that constitutes a good approximation to the HRTFs of the user. For example, the at least one ITE microphone may be constituted by a single microphone positioned at the entrance to the ear canal. The processor conveys the directional information contained in the output signal of the at least one ITE microphone to the resulting hearing loss compensated output signal of the processor so that the hearing loss compensated output signal of the processor also attains a transfer function that constitutes a good approximation to the HRTFs of the user whereby improved localization is provided to the user.

BTE (behind-the-ear) hearings aids are well-known in the art. A BTE hearing aid has a BTE housing that is shaped to be worn behind the pinna of the user. The BTE housing accommodates components for hearing loss compensation. A sound signal transmission member, i.e. a sound tube or an electrical conductor, transmits a signal representing the hearing loss compensated sound from the BTE housing into the ear canal of the user.

In order to position the sound signal transmission member securely and comfortably at the entrance to the ear canal of the user, an earpiece, shell, or earmould may be provided for insertion into the ear canal of the user constituting an open solution. In an open solution, the earpiece, shell, or earmould does not obstruct the ear canal when it is positioned in its intended operational position in the ear canal. Rather, there will be a passageway through the earpiece, shell, or earmould or, between a part of the ear canal wall and a part of the earpiece, shell, or earmould, so that sound waves may escape from behind the earpiece, shell, or earmould between the ear drum and the earpiece, shell, or earmould through the passageway to the surroundings of the user. In this way, the occlusion effect is substantially eliminated.

Typically, the earpiece, shell, or earmould is individually custom manufactured or manufactured in a number of standard sizes to fit the user's ear to sufficiently secure the sound signal transmission member in its intended position in the ear canal and prevent the earpiece from falling out of the ear, e.g., when the user moves the jaw.

The output transducer may be a receiver positioned in the BTE hearing aid housing. In this event, the sound signal transmission member comprises a sound tube for propagation of acoustic sound signals from the receiver positioned in the BTE hearing aid housing and through the sound tube to an earpiece positioned and retained in the ear canal of the user and having an output port for transmission of the acoustic sound signal to the eardrum in the ear canal.

The output transducer may be a receiver positioned in the earpiece. In this event, the sound signal transmission member comprises electrical conductors for propagation of audio signals from the output of a processor in the BTE hearing aid housing through the conductors to a receiver positioned in the earpiece for emission of sound through an output port of the earpiece.

The ITE microphone housing accommodating at least one ITE microphone may be combined with, or be constituted by, the earpiece so that the at least one microphone is positioned proximate the entrance to the ear canal when the earpiece is fastened in its intended position in the ear canal.

The ITE microphone housing may be connected to the earpiece with an arm, possibly a flexible arm that is intended to be positioned inside the pinna, e.g. around the circumference of the conchae abutting the antihelix and at least partly covered by the antihelix for retaining its position inside the outer ear of the user. The arm may be pre-formed during manufacture, preferably into an arched shape with a curvature slightly larger than the curvature of the antihelix, for easy fitting of the arm into its intended position in the pinna. In one example, the arm has a length and a shape that facilitate positioning of the at least one ITE microphone in an operating position immediately below the triangular fossa.

The processor may be accommodated in the BTE hearing aid housing, or in the ear piece, or part of the processor may be accommodated in the BTE hearing aid housing and part of the processor may be accommodated in the ear piece. There is a one-way or two-way communication link between circuitry of the BTE hearing aid housing and circuitry of the earpiece.

The link may be wired or wireless.

Likewise, there is a one-way or two-way communication link between circuitry of the BTE hearing aid housing and the at least one ITE microphone. The link may be wired or wireless.

The processor operates to perform hearing loss compensation while maintaining spatial information of the sound environment for optimum spatial performance of the hearing aid and while at the same time providing as large maximum stable gain as possible.

In the new hearing aid, output signals of an arbitrary configuration of microphones undergo signal processing in such a way that spatial cues are preserved and conveyed to the user of the hearing aid. The output signals are filtered with filters that are configured to preserve spatial cues.

For example a method may be performed in the new hearing aid, comprising the steps of:

for a set of directions l with relation to the BTE hearing aid, determine the Head-Related Transfer functions $HRTF_l(f)$, the hearing aid related transfer function $H_{l,i}^{ITEC}(f)$ of the $i^{th}$ microphone of the at least one ITE microphone for direction l, the hearing aid related transfer functions $H_{l,j}^{BTEC}(f)$ of the $j^{th}$ microphone of the at least one BTE microphone, determine the transfer function $H_{FB,i}^{IEC}(f)$ of the feedback path associated with the $i^{th}$ microphone of the at least one ITE microphone, determine the transfer function $H_{FB,j}^{BTEC}(f)$ of the feedback path associated with the $j^{th}$ microphone of the at least one BTE sound input transducer, and determine transfer functions $G_i^{IEC}(f)$ of the $i^{th}$ cue filter of the at least one cue filter filtering audio signals of the at least one ITE microphone, determine transfer functions $G_j^{BTEC}(f)$ of the $j^{th}$ cue filter of at least one cue filter filtering audio signals of the at least one BTE microphone by solving the following minimization problem:

$$\min_{G_i^{IEC}(f),G_i^{BTEC}(f)} \sum_{i=0}^{L-1} \left\| HRTF_l(f) - \sum_i G_i^{IEC}(f)H_{l,i}^{IEC}(f) - \sum_j G_j^{BTEC}(f)H_{l,j}^{BTEC}(f) \right\|^p$$

wherein p is an integer, e.g. p=2.

Feedback may be taken into account by performing the solution of the minimization problem above subject to the condition that the gain of the feedback loops must be less than one, i.e. subject to the condition that:

$$\frac{1}{\left|\sum_i G_i^{IEC}(f)H_{FB,i}^{IEC}(f) + \sum_j G_j^{BTEC}(f)H_{FB,j}^{BTEC}(f)\right|} \geq MSG(f).$$

Feedback stability may also be ensured by incorporation of the condition into the minimization problem:

$$\min_{G_i^{IEC}(f),G_j^{BTEC}(f)} \left( \sum_{l=0}^{L-1} \left\| HRTF_l(f) - \sum_i G_i^{IEC}(f)H_{l,i}^{IEC}(f) - \sum_j G_j^{BTEC}(f)H_{l,j}^{BTEC}(f) \right\|^p + \alpha \left\| \sum_i G_i^{IEC}(f)H_{FB,i}^{IEC}(f) + \sum_j G_j^{BTEC}(f)H_{FB,j}^{BTEC}(f) \right\|^p \right)$$

wherein α is a weighting factor balancing spatial cue accuracy and feedback performance.

Various weights may be incorporated into the minimization problems above so that the solution is optimized as specified by the values of the weights. For example, frequency weights W(f) may optimize the solution in certain one or more frequency ranges, and angular weights W(l) may optimize the solution for certain directions of arrival of sound. L (l) is the angular direction towards a sound source with respect to the looking direction of a user wearing the hearing aid.

Thus, the minimization problem may be modified into:

$$\min_{G_i^{IEC}(f),G_i^{BTEC}(f)} \sum_{l=0}^{L-1} W(l) \left\| W(f)\left( HRTF_l(f) - \sum_i G_i^{IEC}(f)H_{l,i}^{IEC}(f) - \sum_j G_j^{BTEC}(f)H_{l,j}^{BTEC}(f) \right) \right\|^p$$

subject to $$\frac{1}{\left|\sum_i G_i^{IEC}(f)H_{FB,i}^{IEC}(f) + \sum_j G_j^{BTEC}(f)H_{FB,j}^{BTEC}(f)\right|} \geq MSG(f)$$

or $$\min_{G_i^{IEC}(f),G_j^{BTEC}(f)} \left( \sum_{l=0}^{L-1} W(l) \left\| W(f)\left( HRTF_l(f) - \sum_i G_i^{IEC}(f)H_{l,i}^{IEC}(f) - \sum_j G_j^{BTEC}(f)H_{l,j}^{BTEC}(f) \right) \right\|^p + \alpha \left\| \sum_i G_i^{IEC}(f)H_{FB,i}^{IEC}(f) + \sum_j G_j^{BTEC}(f)H_{FB,j}^{BTEC}(f) \right\|^p \right)$$

Further, in one or more selected frequency ranges, only magnitude of the transfer functions may be taken into account during minimization while phase is disregarded, i.e. in the one or more selected frequency range, the transfer function is substituted by its absolute value.

The target transfer function need not be defined by the HRTF for the various directions l. Any transfer function that includes spatial cues may be used as the target transfer function.

For example, one of the ITE microphones of the at least one ITE microphone may be positioned at a position with relation to the user wherein the transfer function of the ITE microphone approximates the HRTFs of the user so that $HRTF_l(f)$ in the minimization problems specified above may be substituted by the transfer function $H_{l,ref}^{ITEC}(f)$ of the ITE microphone in question:

$$\min_{G_i^{IEC}(f),G_i^{BTEC}(f)} \sum_{l=0}^{L-1} W(l) \left\| W(f) \left( \begin{array}{c} H_{l,ref}^{ITEC}(f) - \\ \sum_{i \neq ref} G_i^{IEC}(f) H_{l,i}^{IEC}(f) - \\ \sum_j G_j^{BTEC}(f) H_{l,j}^{BTEC}(f) \end{array} \right) \right\|^p$$

subject to $$\frac{1}{|\sum_{i \neq ref} G_i^{IEC}(f) H_{FB,i}^{IEC}(f) + \sum_j G_j^{BTEC}(f) H_{FB,j}^{BTEC}(f)|} \geq MSG(f)$$

or $$\min_{G_i^{IEC}(f),G_j^{BTEC}(f)} \left( \begin{array}{c} \sum_{l=0}^{L-1} W(l) \left\| W(f) \left( \begin{array}{c} H_{l,ref}^{ITEC}(f) - \\ \sum_{i \neq ref} G_i^{IEC}(f) H_{l,i}^{IEC}(f) - \\ \sum_j G_j^{BTEC}(f) H_{l,j}^{BTEC}(f) \end{array} \right) \right\|^p + \\ \alpha \left\| \begin{array}{c} \sum_{i \neq ref} G_i^{IEC}(f) H_{FB,i}^{IEC}(f) + \\ \sum_j G_j^{BTEC}(f) H_{FB,j}^{BTEC}(f) \end{array} \right\|^p \end{array} \right)$$

The output signal of each of the at least one ITE microphone may be pre-processed.

The output signal of each of the at least one BTE sound input transducer may be pre-processed.

Pre-processing may include, without excluding any form of processing; adaptive and/or static feedback suppression, adaptive or fixed beamforming and pre-filtering.

The at least one ITE microphone may operate as monitor microphone(s) for generation of an electronic sound signal with the desired spatial information of the current sound environment.

Each output signal of the at least one BTE sound input transducer and of the at least one ITE microphone is filtered with a respective cue filter, the transfer function of which are configured to provide a combined output signal of the cue filters with a transfer function that approximates the HRTFs of the user as closely as possible.

Subsequent to the cue filtering, the combined output signal of the cue filters is passed on for further hearing loss compensation processing, e.g. with a compressor. In this way, signals from the at least one BTE sound input transducer and the at least one ITE microphone are appropriately processed before hearing loss compensation whereby risk of feedback from the output transducer to the at least one ITE microphone and the at least one BTE sound input transducer is minimized and a large maximum stable gain can be provided.

The determinations, for a set of directions l with relation to the new hearing aid, of the Head-Related Transfer functions $HRTF_l(f)$, the hearing aid related transfer function of the respective at least one ITE microphone $H_{l,i}^{ITEC}(f)$, and the hearing aid related transfer functions of the respective at least one BTE microphone $H_{l,j}^{BTEC}(f)$ may be performed with the hearing aid mounted on an artificial head.

Individual determinations, for a set of directions l with relation to the new hearing aid, of the Head-Related Transfer functions $HRTF_l(f)$, the hearing aid related transfer function of the respective at least one ITE microphone $H_{l,i}^{ITEC}(f)$, and the hearing aid related transfer functions of the respective at least one BTE microphone $H_{l,i}^{BTEC}(f)$ may be performed for a number of users representing a selected group of users, and the transfer functions of the at least one cue filter $G_j^{BTEC}(f)$ of the respective at least one BTE sound transducer may be determined based on averaged values of the Head-Related Transfer functions $HRTF_l(f)$, the hearing aid related transfer function of the respective at least one ITE microphone $H_{l,i}^{ITEC}(f)$, and the hearing aid related transfer functions of the respective at least one BTE microphone $H_{l,i}^{BTEC}(f)$ of the number of users representing the selected group of users.

Thus, the at least one cue filter $G_i^{IEC}(f)$ of the respective at least one ITE microphone and the at least one cue filter $G_j^{BTEC}(f)$ of the respective at least one BTE sound transducer may be determined by the following steps:

With the hearing aid worn by the individual user:

1) Measure the Head-Related Transfer functions $HRTF_l(f)$, the hearing aid related transfer functions $H_{l,i}^{ITEC}(f)$ and the hearing aid related transfer functions $H_{l,i}^{BTEC}(f)$,
2) Measure the transfer functions $H_{FB,i}^{IEC}(f)$ of the feedback path associated with the $i^{th}$ microphone of the at least one ITE microphone and the transfer functions $H_{FB,j}^{BTEC}(f)$ of the feedback paths associated with the $j^{th}$ microphone of the at least one BTE sound input transducer.
3) Determine the at least one cue filter $G_i^{IEC}(f)$ of the respective at least one ITE microphone and the at least one cue filter $G_j^{BTEC}(f)$ of the respective at least one BTE sound transducer solving a selected one of the minimization problems mentioned above.

Some of the measurements above need not be performed with the individual user; rather measurements may be performed that constitute good approximations to individual measurements for a number of humans with certain characteristics in common, e.g. humans within a certain age group, population, etc.:

For a number of user's with certain characteristics in common:

1) Measure the Head-Related Transfer functions $HRTF_l(f)$, the hearing aid related transfer functions $H_{l,i}^{ITEC}(f)$, and the hearing aid related transfer functions $H_{l,i}^{BTEC}(f)$ with the hearing aid mounted on an artificial head, e.g. for a number of differently sized ears; or, with the hearing aid worn by a number of humans,
2) Determine average Head-Related Transfer functions $HRTF_l(f)$, hearing aid related transfer functions $H_{l,i}^{ITEC}(f)$ and hearing aid related transfer functions $H_{l,i}^{BTEC}(f)$ for the population in question, e.g. one for big ears, one for small ears, etc, and For the individual user:

3) With the hearing aid worn by the individual user: Measure the transfer functions $H_{FB,i}^{IEC}(f)$ of the feedback path associated with the microphone of the at least one ITE microphone and the transfer functions $H_{FB,j}^{BTEC}(f)$ of the feedback paths associated with the $j^{th}$ microphone of the at least one BTE sound input transducer.

4) Determine the at least one cue filter $G_i^{IEC}(f)$ of the respective at least one ITE microphone and the at least one cue filter $G_j^{BTEC}(f)$ of the respective at least one BTE sound transducer solving a selected one of the minimization problems mentioned above.

The audio signals may be divided into a plurality of frequency channels, and be individually processed in individual frequency channels, and the transfer functions of the at least one cue filter $G_i^{IEC}(f)$ of the respective at least one ITE microphone, the at least one cue filter $G_j^{BTEC}(f)$ of the respective at least one BTE sound transducer may be individually determined in selected frequency channels.

The at least one BTE microphone may be disconnected from the processor in one or more selected frequency channels so that hearing loss compensation is performed solely on the output of the at least one ITE microphone in the one or more selected frequency channels.

As used herein, the terms "processor", "signal processor", "controller", "system", etc. (each of which may be considered as an example of a "processing unit"), are intended to refer to CPU-related entities, either hardware, a combination of hardware and software, software, or software in execution.

For example, a "processor", "signal processor", "controller", "system", etc., may be, but is not limited to being, a process running on a processor, a processor, an object, an executable file, a thread of execution, and/or a program.

By way of illustration, the terms "processor", "signal processor", "controller", "system", etc., designate both an application running on a processor and a hardware processor. One or more "processors", "signal processors", "controllers", "systems" and the like, or any combination hereof, may reside within a process and/or thread of execution, and one or more "processors", "signal processors", "controllers", "systems", etc., or any combination hereof, may be localized on one hardware processor, possibly in combination with other hardware circuitry, and/or distributed between two or more hardware processors, possibly in combination with other hardware circuitry.

A method of determining parameters of a BTE hearing aid having at least one ITE microphone and at least one BTE microphone, the method includes: determining Head-Related Transfer functions $HRTF_l(f)$; determining a hearing aid related transfer function $H_{l,i}^{ITEC}(f)$ of a $i^{th}$ microphone of the at least one ITE microphone for direction l; determining a hearing aid related transfer functions $H_{l,j}^{BTEC}(f)$ of a $j^{th}$ microphone of the at least one BTE microphone; determining transfer functions $G_i^{IEC}(f)$ of a $i^{th}$ cue filter of at least one cue filter filtering audio sound signals of the at least one ITE microphone; and determining transfer functions $G_j^{BTEC}(f)$ of a $j^{th}$ cue filter of the at least one cue filter filtering audio sound signals of the at least one BTE microphone; wherein the transfer functions $G_i^{IEC}(f)$ and the transfer functions $G_j^{BTEC}(f)$ are determined using a processing unit based on an equation:

$$\min_{G_i^{IEC}(f),G_j^{BTEC}(f)} \sum_{l=0}^{L-1} W(l) \left\| W(f) \left( HRTF_l(f) - \sum_i G_i^{IEC}(f) H_{l,i}^{IEC}(f) - \sum_j G_j^{BTEC}(f) H_{l,j}^{BTEC}(f) \right) \right\|^p$$

wherein W(l) is an angular weighting factor, W(f) is a frequency dependent weighting factor, and p is a positive integer.

Optionally, the method may further include determining a transfer function $H_{FB,i}^{IEC}(f)$ of a feedback path associated with the $i^{th}$ microphone of the at least one ITE microphone; and determining a transfer function $H_{FB,j}^{BTEC}(f)$ of a feedback path associated with the $j^{th}$ microphone of the at least one BTE microphone.

Optionally, the method may further include determining filter coefficients of the at least one cue filter associated with the at least one ITE microphone, and filter coefficients of the at least one cue filter associated with the at least one BTE microphone by solving:

$$\min_{G_i^{IEC}(f),G_j^{BTEC}(f)} \sum_{l=0}^{L-1} W(l) \left\| W(f) \left( HRTF_l(f) - \sum_i G_i^{IEC}(f) H_{l,i}^{IEC}(f) - \sum_j G_j^{BTEC}(f) H_{l,j}^{BTEC}(f) \right) \right\|^p$$

subject to $$\frac{1}{\left|\sum_i G_i^{IEC}(f) H_{FB,i}^{IEC}(f) + \sum_j G_j^{BTEC}(f) H_{FB,j}^{BTEC}(f)\right|} \geq MSG(f).$$

wherein MSG(f) is a maximum stable gain.

Optionally, the method may further include determining filter coefficients of the at least one cue filter associated with the at least one ITE microphone, and filter coefficients of the at least one cue filter associated with the at least one BTE microphone by solving:

$$\min_{G_i^{IEC}(f),G_j^{BTEC}(f)} \left( \sum_{l=0}^{L-1} W(l) \left\| W(f) \left( HRTF_l(f) - \sum_i G_i^{IEC}(f) H_{l,i}^{IEC}(f) - \sum_j G_j^{BTEC}(f) H_{l,j}^{BTEC}(f) \right) \right\|^p + \alpha \left\| \sum_i G_i^{IEC}(f) H_{FB,i}^{IEC}(f) + \sum_j G_j^{BTEC}(f) H_{FB,j}^{BTEC}(f) \right\|^p \right)$$

wherein α is a weighting factor balancing spatial cue accuracy and feedback performance.

Optionally, the Head-Related Transfer functions $HRTF_l(f)$ is determined using a hearing aid related transfer function $H_{l,ref}^{ITEC}(f)$, and wherein filter coefficients of the at least one cue filter filtering audio sound signals of the at least one ITE microphone, and filter coefficients of the at least one cue filter filtering audio sound signals of the at least one BTE microphone are determined by solving equation:

$$\min_{G_i^{IEC}(f),G_i^{BTEC}(f)} \sum_{l=0}^{L-1} W(l) \left\| W(f) \left( \begin{array}{c} H_{l,ref}^{ITEC}(f) - \\ \sum_{i \neq ref} G_i^{IEC}(f) H_{l,i}^{IEC}(f) - \\ \sum_j G_j^{BTEC}(f) H_{l,j}^{BTEC}(f) \end{array} \right) \right\|^p$$

subject to $$\frac{1}{|\sum_{i \neq ref} G_i^{IEC}(f) H_{FB,i}^{IEC}(f) + \sum_j G_j^{BTEC}(f) H_{FB,j}^{BTEC}(f)|} \geq MSG(f)$$

wherein MSG(f) is a maximum stable gain.

Optionally, the Head-Related Transfer functions $HRTF_l(f)$ is determined using a hearing aid related transfer function $H_{l,ref}^{ITEC}(f)$, and wherein filter coefficients of the at least one cue filter filtering audio sound signals of the at least one ITE microphone, and filter coefficients of the at least one cue filter filtering audio sound signals of the at least one BTE microphone are determined by solving equation:

$$\min_{G_i^{IEC}(f),G_j^{BTEC}(f)} \left( \begin{array}{c} \sum_{l=0}^{L-1} W(l) \left\| W(f) \left( \begin{array}{c} H_{l,ref}^{ITEC}(f) - \\ \sum_{i \neq ref} G_i^{IEC}(f) H_{l,i}^{IEC}(f) - \\ \sum_j G_j^{BTEC}(f) H_{l,j}^{BTEC}(f) \end{array} \right) \right\|^p + \\ \alpha \left\| \begin{array}{c} \sum_{i \neq ref} G_i^{IEC}(f) H_{FB,i}^{IEC}(f) + \\ \sum_j G_j^{BTEC}(f) H_{FB,j}^{BTEC}(f) \end{array} \right\|^p \end{array} \right)$$

wherein $\alpha$ is a weighting factor balancing spatial cue accuracy and feedback performance.

Optionally, the acts of determining the Head-Related Transfer functions $HRTF_l(f)$, the hearing aid related transfer function $H_{l,i}^{ITEC}(f)$, and the hearing aid related transfer functions $H_{l,i}^{BTEC}(f)$ are performed with the hearing aid mounted on an artificial head.

Optionally, the acts of determining the Head-Related Transfer functions $HRTF_l(f)$, the hearing aid related transfer function $H_{l,i}^{ITEC}(f)$, and the hearing aid related transfer functions $H_{l,i}^{BTEC}(f)$ are performed for a number of users; and wherein filter coefficients of the at least one cue filter filtering audio sound signals of the at least one BTE microphone are determined based on an average value of the Head-Related Transfer functions $HRTF_l(f)$, an average value of the hearing aid related transfer function $H_{l,i}^{ITEC}(f)$, and an average value of the hearing aid related transfer functions $H_{l,i}^{BTEC}(f)$, of the number of users.

Optionally, the hearing aid has a plurality of frequency channels; and wherein filter coefficients of the at least one cue filter filtering audio sound signals of the at least one ITE microphone, and filter coefficients of the at least one cue filter filtering audio sound signals of the at least one BTE microphone are determined in one or more of the frequency channels.

Optionally, the method may further include disconnecting the at least one BTE microphone in one or more of the frequency channels so that hearing loss compensation is performed solely on an output of the at least one ITE microphone.

Optionally, the method may further include generating a hearing loss compensated output signal based on a combination of filtered audio sound signals output by the at least one cue filter filtering audio sound signals of the at least one ITE microphone, or by the at least one cue filter filtering audio sound signals of the at least one BTE microphone, or by both.

Optionally, W(l)=1.

Optionally, W(f)=1.

Optionally, p=2.

An apparatus for determining parameters of a BTE hearing aid having at least one ITE microphone and at least one BTE microphone, includes a processing unit configured for: determining Head-Related Transfer functions $HRTF_i(f)$; determining a hearing aid related transfer function $H_{l,i}^{ITEC}(f)$ of a $i^{th}$ microphone of the at least one ITE microphone for direction l; determining a hearing aid related transfer functions $H_{l,j}^{BTEC}(f)$ of a $j^{th}$ microphone of the at least one BTE microphone; determining transfer functions $G_i^{ITEC}(f)$ of a $i^{th}$ cue filter of at least one cue filter filtering audio sound signals of the at least one ITE microphone; and determining transfer functions $G_j^{BTEC}(f)$ of a $j^{th}$ cue filter of the at least one cue filter filtering audio sound signals of the at least one BTE microphone; wherein the processing unit is configured for determining the transfer functions $G_i^{IEC}(f)$ and the transfer functions $G_j^{BTEC}(f)$ based on equation:

$$\min_{G_i^{IEC}(f),G_i^{BTEC}(f)} \sum_{l=0}^{L-1} W(l) \left\| W(f) \left( \begin{array}{c} HRTF_l(f) - \\ \sum_i G_i^{IEC}(f) H_{l,i}^{IEC}(f) - \\ \sum_j G_j^{BTEC}(f) H_{l,j}^{BTEC}(f) \end{array} \right) \right\|^p$$

wherein W(l) is an angular weighting factor, W(f) is a frequency dependent weighting factor, and p is a positive integer.

Optionally, the processing unit may be further configured for: determining a transfer function $H_{FB,i}^{IEC}(f)$ of a feedback path associated with the $i^{th}$ microphone of the at least one ITE microphone; and determining a transfer function $H_{FB,j}^{BTEC}(f)$ of a feedback path associated with the $j^{th}$ microphone of the at least one BTE microphone.

Optionally, the processing unit may be further configured for: determining filter coefficients of the at least one cue filter associated with the at least one ITE microphone, and filter coefficients of the at least one cue filter associated with the at least one BTE microphone by solving:

$$\min_{G_i^{IEC}(f),G_i^{BTEC}(f)} \sum_{l=0}^{L-1} W(l) \left\| W(f) \left( \begin{array}{c} HRTF_l(f) - \\ \sum_i G_i^{IEC}(f) H_{l,i}^{IEC}(f) - \\ \sum_j G_j^{BTEC}(f) H_{l,j}^{BTEC}(f) \end{array} \right) \right\|^p$$

subject to $$\frac{1}{|\sum_i G_i^{IEC}(f) H_{FB,i}^{IEC}(f) + \sum_j G_j^{BTEC}(f) H_{FB,j}^{BTEC}(f)|} \geq MSG(f).$$

wherein MSG(f) is a maximum stable gain.

Optionally, the processing unit may be further configured for: determining filter coefficients of the at least one cue filter associated with the at least one ITE microphone, and filter coefficients of the at least one cue filter associated with the at least one BTE microphone by solving:

$$\min_{G_i^{IEC}(f),G_j^{BTEC}(f)}\left(\sum_{l=0}^{L-1}W(l)\left\|W(f)\left(\begin{array}{c}HRTF_l(f)-\\ \sum_i G_i^{IEC}(f)H_{l,i}^{IEC}(f)-\\ \sum_j G_j^{BTEC}(f)H_{l,j}^{BTEC}(f)\end{array}\right)\right\|^p+\alpha\left\|\begin{array}{c}\sum_i G_i^{IEC}(f)H_{FB,i}^{IEC}(f)+\\ \sum_j G_j^{BTEC}(f)H_{FB,j}^{BTEC}(f)\end{array}\right\|^p\right)$$

wherein α is a weighting factor balancing spatial cue accuracy and feedback performance.

Optionally, the Head-Related Transfer functions $HRTF_l(f)$ is based on a hearing aid related transfer function $H_{l,ref}^{ITEC}(f)$, and wherein the processing unit is configured to determine filter coefficients of the at least one cue filter filtering audio sound signals of the at least one ITE microphone, and filter coefficients of the at least one cue filter filtering audio sound signals of the at least one BTE microphone by solving equation:

$$\min_{G_i^{IEC}(f),G_i^{BTEC}(f)}\sum_{l=0}^{L-1}W(l)\left\|W(f)\left(\begin{array}{c}H_{l,ref}^{ITEC}(f)-\\ \sum_{i\neq ref} G_i^{IEC}(f)H_{l,i}^{IEC}(f)-\\ \sum_j G_j^{BTEC}(f)H_{l,j}^{BTEC}(f)\end{array}\right)\right\|^p$$

subject to $$\frac{1}{\left|\sum_{i\neq ref} G_i^{IEC}(f)H_{FB,i}^{IEC}(f)+\sum_j G_j^{BTEC}(f)H_{FB,j}^{BTEC}(f)\right|}\geq MSG(f)$$

wherein MSG(f) is a maximum stable gain.

Optionally, the Head-Related Transfer functions $HRTF_l(f)$ is based on a hearing aid related transfer function $H_{l,ref}^{ITEC}(f)$, and wherein the processing unit is configured to determine filter coefficients of the at least one cue filter filtering audio sound signals of the at least one ITE microphone, and filter coefficients of the at least one cue filter filtering audio sound signals of the at least one BTE microphone by solving equation:

$$\min_{G_i^{IEC}(f),G_j^{BTEC}(f)}\left(\sum_{l=0}^{L-1}W(l)\left\|W(f)\left(\begin{array}{c}H_{l,ref}^{ITEC}(f)-\\ \sum_{i\neq ref} G_i^{IEC}(f)H_{l,i}^{IEC}(f)-\\ \sum_j G_j^{BTEC}(f)H_{l,j}^{BTEC}(f)\end{array}\right)\right\|^p+\alpha\left\|\begin{array}{c}\sum_{i\neq ref} G_i^{IEC}(f)H_{FB,i}^{IEC}(f)+\\ \sum_j G_j^{BTEC}(f)H_{FB,j}^{BTEC}(f)\end{array}\right\|^p\right)$$

wherein α is a weighting factor balancing spatial cue accuracy and feedback performance.

Optionally, the processing unit may be configured for determining the Head-Related Transfer functions $HRTF_l(f)$, the hearing aid related transfer function $H_{l,i}^{ITEC}(f)$ and the hearing aid related transfer functions $H_{l,i}^{BTEC}(f)$ with the hearing aid mounted on an artificial head.

Optionally, the processing unit may be configured for determining the Head-Related Transfer functions $HRTF_l(f)$, the hearing aid related transfer function $H_{l,i}^{ITEC}(f)$, and the hearing aid related transfer functions $H_{l,i}^{BTEC}(f)$ for a number of users; and wherein the processing unit may be configured to determine filter coefficients of the at least one cue filter filtering audio sound signals of the at least one BTE microphone based on an average value of the Head-Related Transfer functions $HRTF_l(f)$, an average value of the hearing aid related transfer function $H_{l,i}^{ITEC}(f)$, and an average value of the hearing aid related transfer functions $H_{l,i}^{BTEC}(f)$, of the number of users.

Optionally, the BTE hearing aid may have a plurality of frequency channels; and wherein the processing unit may be configured for determining filter coefficients of the at least one cue filter filtering audio sound signals of the at least one ITE microphone, and filter coefficients of the at least one cue filter filtering audio sound signals of the at least one BTE microphone, in one or more of the frequency channels.

Optionally, the processing unit may be further configured for disconnecting the at least one BTE microphone in one or more of the frequency channels so that hearing loss compensation is performed solely on an output of the at least one ITE microphone.

Optionally, the processing unit may be further configured for generating a hearing loss compensated output signal based on a combination of filtered audio sound signals output by the at least one cue filter filtering audio sound signals of the at least one ITE microphone, or by the at least one cue filter filtering audio sound signals of the at least one BTE microphone, or by both.

Optionally, W(l)=1.

Optionally, W(f)=1.

Optionally, p=2.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only exemplary embodiments and are not therefore to be considered limiting in the scope of the claims.

DETAILED DESCRIPTION

Figure 1:
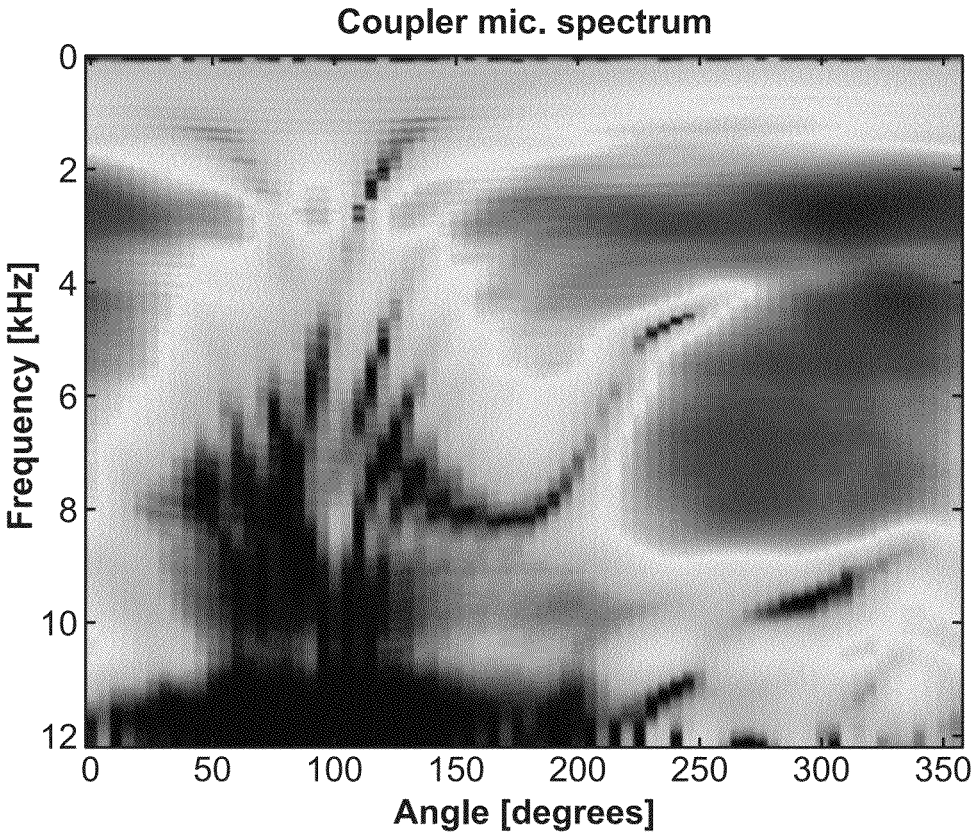
FIG. 1 shows a plot of the angular frequency spectrum of an open ear.
Figure 2:
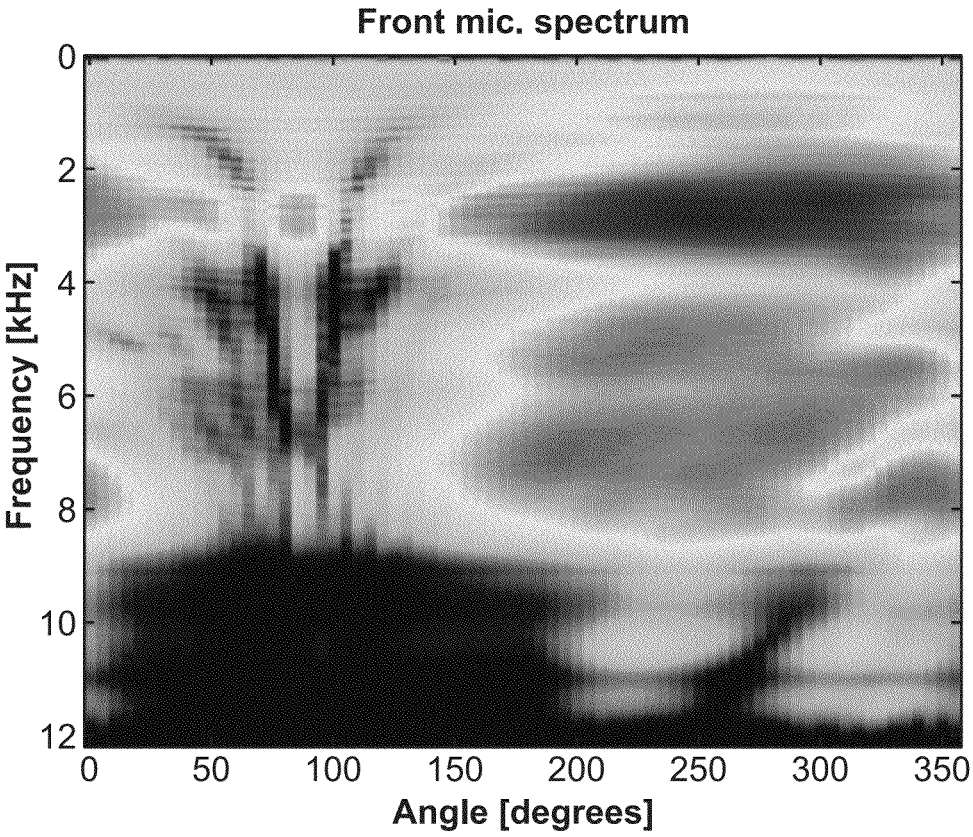
FIG. 2 shows a plot of the angular frequency spectrum of a BTE front microphone worn at the same ear.
Figure 3:
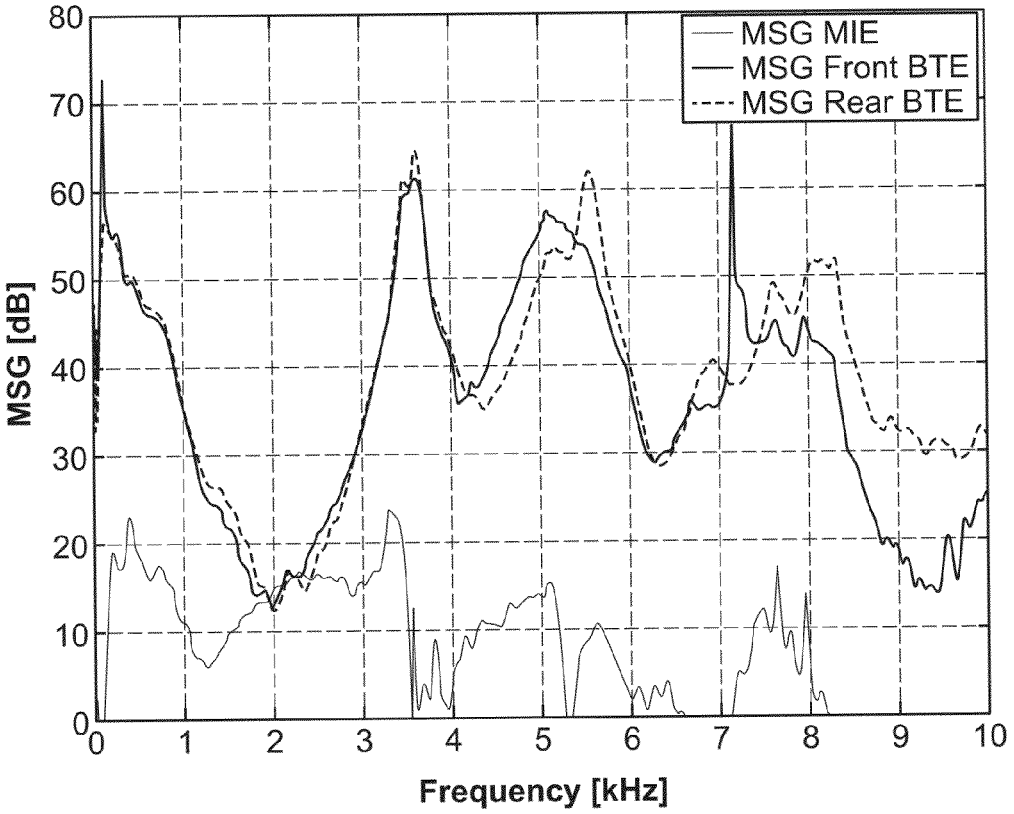
FIG. 3 shows plots of maximum stable gain of a BTE front and rear microphones and an open fitted ITE microphone positioned in the ear canal, FIG. 4 schematically illustrates an exemplary new hearing aid, FIG. 5 schematically illustrates another exemplary new hearing aid.

Various embodiments are described hereinafter with reference to the figures. It should be noted that the figures are not necessarily drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Figure 4:
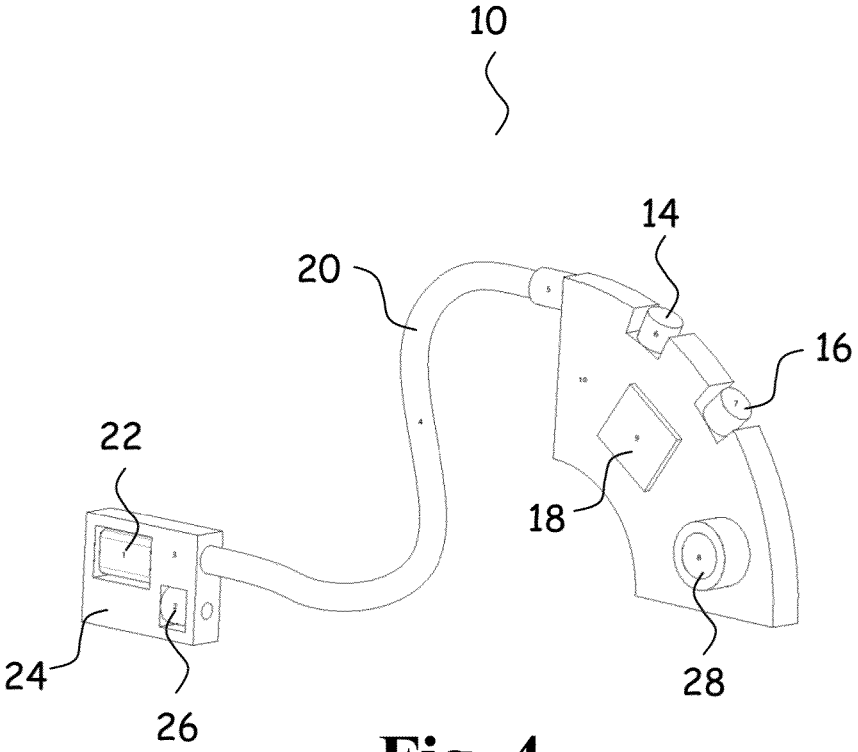

FIG. 4 schematically illustrates an example of the new hearing aid 10 comprising a BTE hearing aid housing 12 (not shown—outer walls have been removed to make internal parts visible) to be worn behind the pinna 100 of a user. The BTE housing 12 accommodates at least one BTE sound input transducer 14, 16 with a front microphone 14 and a rear microphone 16 for conversion of a sound signal into a microphone audio signal, optional pre-filters (not shown) for filtering the respective microphone audio signals, A/D converters (not shown) for conversion of the respective microphone audio signals into respective digital microphone audio signals that are input to a processor 18 configured to generate a hearing loss compensated output signal based on the input digital audio signals.

The hearing loss compensated output signal is transmitted through electrical wires contained in a sound signal transmission member 20 to a receiver 22 for conversion of the hearing loss compensated output signal to an acoustic output signal for transmission towards the eardrum of a user and contained in an earpiece 24 that is shaped (not shown) to be comfortably positioned in the ear canal of a user for fastening and retaining the sound signal transmission member in its intended position in the ear canal of the user as is well-known in the art of BTE hearing aids.

The earpiece 24 also holds one ITE microphone 26 that is positioned at the entrance to the ear canal when the earpiece is positioned in its intended position in the ear canal of the user. The ITE microphone 26 is connected to an A/D converter (not shown) and optional to a pre-filter (not shown) in the BTE housing 12, with electrical wires (not visible) contained in the sound transmission member 20.

The BTE hearing aid 10 is powered by battery 28.

Various possible functions of the processor 18 are disclosed above and some of these in more detail below.

Figure 5:
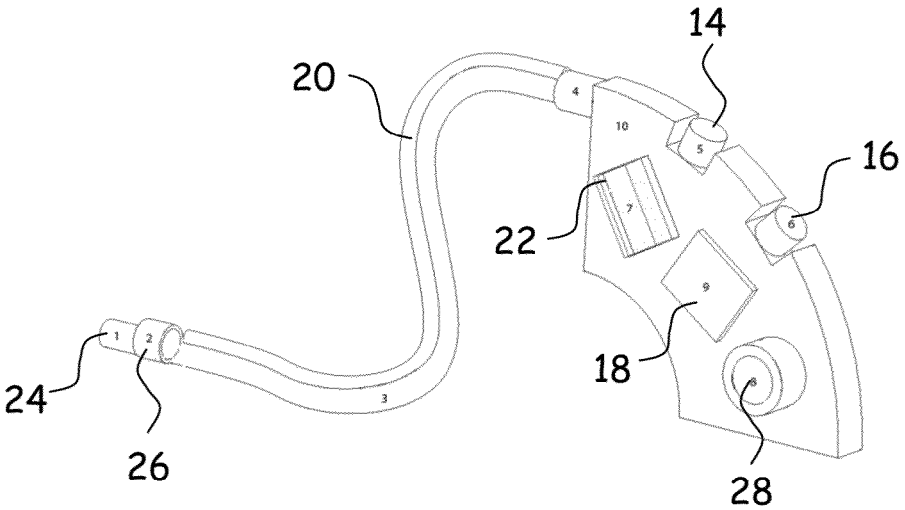

FIG. 5 schematically illustrates another BTE hearing aid 10 similar to the hearing aid shown in FIG. 1, except for the difference that in FIG. 5, the receiver 22 is positioned in the hearing aid housing 12 and not in the earpiece 24, so that acoustic sound output by the receiver 22 is transmitted through the sound tube 20 and towards the eardrum of the user when the earpiece 24 is positioned in its intended position in the ear canal of the user.

The positioning of the ITE microphone 26 proximate the entrance to the ear canal of the user when the BTE hearing aids 10 of FIGS. 4 and 5 are used is believed to lead to a good reproduction of the HRTFs of the user.

Figure 6:
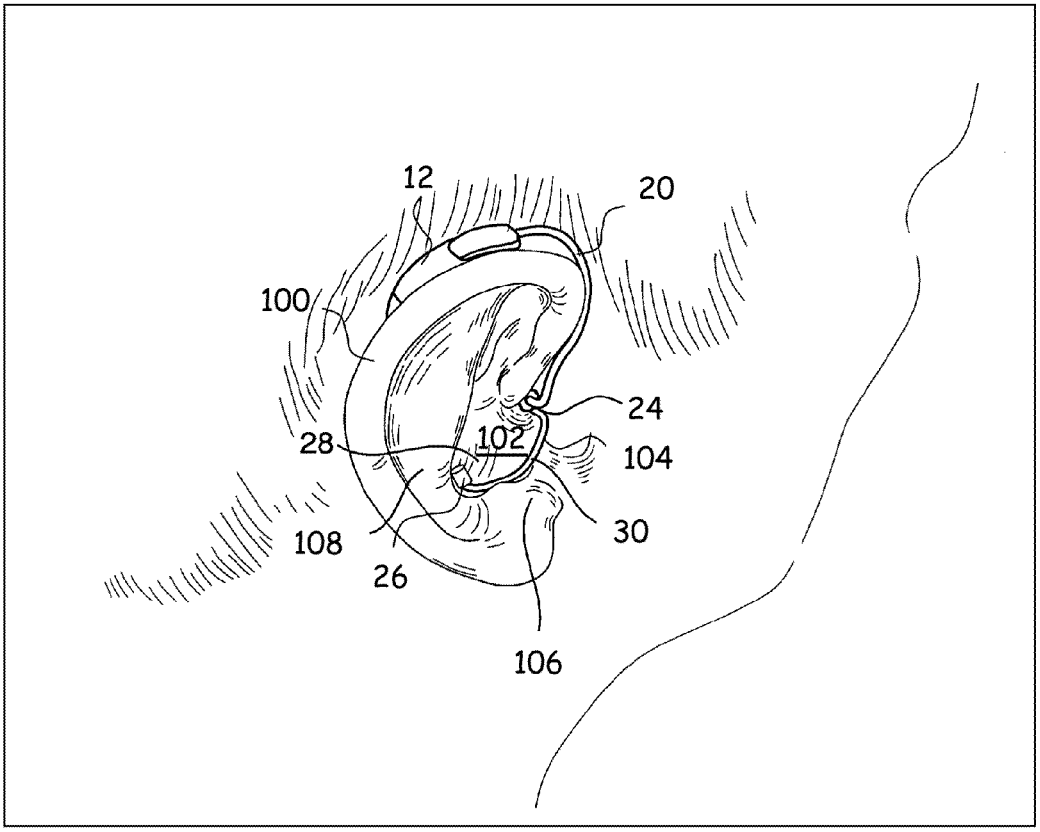
FIG. 6 shows in perspective a new hearing aid with an ITE-microphone in the outer ear of a user.

FIG. 6 shows a BTE hearing aid 10 in its operating position with the BTE housing 12 behind the ear, i.e. behind the pinna 100, of the user. The illustrated BTE hearing aid 10 is similar to the hearing aids shown in FIGS. 4 and 5 except for the fact that the ITE microphone 26 is positioned in the outer ear of the user outside the ear canal at the free end of an arm 30. The arm 30 is flexible and the arm 30 is intended to be positioned inside the pinna 100, e.g. around the circumference of the conchae 102 behind the tragus 104 and antitragus 106 and abutting the antihelix 108 and at least partly covered by the antihelix for retaining its position inside the outer ear of the user. The arm may be pre-formed during manufacture, preferably into an arched shape with a curvature slightly larger than the curvature of the antihelix 108, for easy fitting of the arm 30 into its intended position in the pinna. The arm 30 contains electrical wires (not visible) for interconnection of the ITE microphone 26 with other parts of the BTE hearing aid circuitry.

In one example, the arm 30 has a length and a shape that facilitate positioning of the ITE microphone 26 in an operating position below the triangular fossa.

Figure 7:
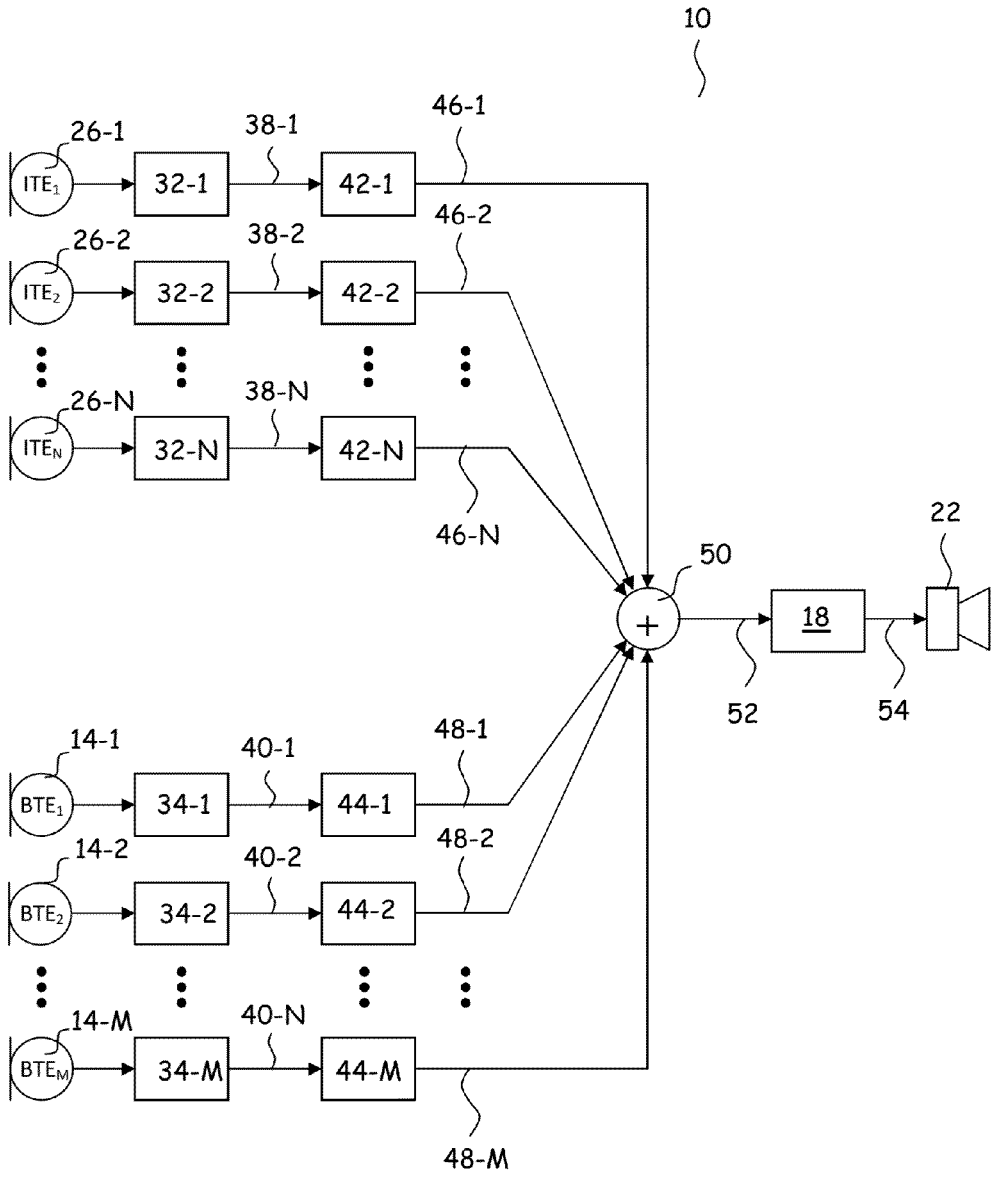
FIG. 7 shows a schematic block diagram of an exemplary new hearing aid with cue filters.

FIG. 7 is a block diagram illustrating one example of signal processing in the new hearing aid 10. The BTE hearing aid 10 has an array of microphones 14-1, 14-2, . . . , 14-M, 26-1, 26-2, . . . , 26-N, for example constituted by a front microphone 14 and a rear microphone 16 and an ITE microphone 26 that resides in an earpiece 24 to be positioned in the outer ear of the user as illustrated in FIGS. 4-6. N and M can be any integer, e.g. N=1, and M=2.

The microphone output audio signals are digitized (A/D-converters not shown) and pre-processed, such as pre-filtered, in respective pre-processors 32-1, 32-2, . . . , 32-N, 34-1, 34-2, . . . , 34-M. The digitized and possibly pre-processed microphone output audio signals 38-1, 38-2, . . . , 38-N, 40-1, 40-2, . . . , 40-M are filtered in cue filters 42-1, 42-2, . . . , 42-N, 44-1, 44-2, . . . , 44-M and the filtered signals 46-1, 46-2, . . . , 46-N, 48-1, 48-2, . . . , 48-M are added to each other in adder 50 and the combined signal 52 is input to a processor 18 for hearing loss compensation. The hearing loss compensated signal 54 is output to a receiver 22 that converts the signal to an acoustic signal for transmission towards the ear drum of the user.

The new hearing aid circuitry shown in FIG. 7 may operate in the entire frequency range of the BTE hearing aid 10.

The hearing aid 10 shown in FIG. 7 may be a multi-channel hearing aid in which microphone output audio signals are divided into a plurality of frequency channels, and wherein divided signals are processed individually in each of the frequency channels.

For a multi-channel hearing aid 10, FIG. 7 may illustrate the circuitry and signal processing in a single frequency channel. The circuitry and signal processing may be duplicated in a plurality of the frequency channels, e.g. in all of the frequency channels.

For example, the signal processing illustrated in FIG. 7 may be performed in a selected frequency band, e.g. selected during fitting of the hearing aid 10 to a specific user at a dispenser's office.

The selected frequency band may comprise one or more of the frequency channels, or all of the frequency channels. The selected frequency band may be fragmented, i.e. the selected frequency band need not comprise consecutive frequency channels.

The plurality of frequency channels may include warped frequency channels, for example all of the frequency channels may be warped frequency channels.

Outside the selected frequency band, one or more of the at least one ITE microphone may be connected conventionally as an input source to the processor of the hearing aid and may cooperate with the processor of the hearing aid in a well-known way.

In this way, one or more or all of the at least one ITE microphone provide the input to the processor 18 at frequencies where the hearing aid is capable of supplying the desired gain based on the input from the one or more of the at least one ITE microphone. In the selected frequency band, wherein the hearing aid cannot supply the desired gain with this configuration, the microphones of BTE hearing aid housing are included in the signal processing as disclosed above. In this way, the gain can be increased while simultaneously maintain the spatial information about the sound environment as provided by the array of microphones.

The transfer functions of the Cue filters 42-1, 42-2, . . . , 42-N, 44-1, 44-2, . . . , 44-M has been determined before use, e.g. at the dispenser's office, by the following steps:

1) Measure the Head-Related Transfer functions $HRTF_l(f)$, the hearing aid related transfer functions $H_{l,i}^{ITEC}(f)$ and the hearing aid related transfer functions $H_{l,i}^{BTEC}(f)$ with the hearing aid mounted on an artificial head, e.g. for a number of differently sized ears; or, with the hearing aid worn by a number of humans, 2) Determine average Head-Related Transfer functions $HRTF_l(f)$, hearing aid related transfer functions $H_{l,i}^{ITEC}(f)$ and hearing aid related transfer functions $H_{l,i}^{BTEC}(f)$ for the population in question, e.g. one for big ears, one for small ears, etc, 3) With the hearing aid worn by the individual user: Measure the transfer functions $H_{FB,i}^{IEC}(f)$ of the feedback path associated with the microphone of the at least one ITE microphone and the transfer functions $H_{FB,j}^{BTEC}(f)$ of the feedback paths associated with the $j^{th}$ microphone of the at least one BTE sound input transducer.

4) Determine the transfer function of the at least one cue filter $G_i^{IEC}(f)$ and the at least one cue filter $G_j^{BTEC}(f)$ solving a selected one of the following minimization problems:

$$\min_{G_i^{IEC}(f),G_j^{BTEC}(f)} \sum_{l=0}^{L-1} \left\| \begin{matrix} HRTF_l(f) - \\ \sum_i G_i^{IEC}(f)H_{l,i}^{IEC}(f) - \\ \sum_j G_j^{BTEC}(f)H_{l,j}^{BTEC}(f) \end{matrix} \right\|^p$$

wherein p is an integer, e.g. p=2.

In order to ensure feedback stability, the minimization problem may be solved subject to the condition that:

$$\frac{1}{|\sum_i G_i^{IEC}(f)H_{FB,i}^{IEC}(f) + \sum_j G_j^{BTEC}(f)H_{FB,j}^{BTEC}(f)|} \geq MSG(f).$$

Feedback stability may also be ensured by incorporation of the condition into the minimization problem:

$$\min_{G_i^{IEC}(f),G_j^{BTEC}(f)} \left( \sum_{l=0}^{L-1} \left\| \begin{matrix} HRTF_l(f) - \\ \sum_i G_i^{IEC}(f)H_{l,i}^{IEC}(f) - \\ \sum_j G_j^{BTEC}(f)H_{l,j}^{BTEC}(f) \end{matrix} \right\|^p + \alpha \left\| \begin{matrix} \sum_i G_i^{IEC}(f)H_{FB,i}^{IEC}(f) + \\ \sum_j G_j^{BTEC}(f)H_{FB,j}^{BTEC}(f) \end{matrix} \right\| \right)$$

wherein α is a weighting factor balancing spatial cue accuracy and feedback performance.

Various weights may be incorporated into the minimization problems above so that the solution is optimized as specified by the values of the weights. For example, frequency weights W(f) may optimize the solution in certain one or more frequency ranges, and angular weights W(l) may optimize the solution for certain directions of arrival of sound. Thus, the minimization problem may be modified into:

$$\min_{G_i^{IEC}(f),G_j^{BTEC}(f)} \sum_{l=0}^{L-1} W(l) \left\| W(f) \left( \begin{matrix} HRTF_l(f) - \\ \sum_i G_i^{IEC}(f)H_{l,i}^{IEC}(f) - \\ \sum_j G_j^{BTEC}(f)H_{l,j}^{BTEC}(f) \end{matrix} \right) \right\|^p$$

subject to $$\frac{1}{|\sum_i G_i^{IEC}(f)H_{FB,i}^{IEC}(f) + \sum_j G_j^{BTEC}(f)H_{FB,j}^{BTEC}(f)|} \geq MSG(f)$$

or

-continued $$\min_{G_i^{IEC}(f),G_j^{BTEC}(f)}\left(\sum_{l=0}^{L-1}W(l)\left\|W(f)\left(\begin{array}{c}HRTF_l(f)-\\ \sum_i G_i^{IEC}(f)H_{l,i}^{IEC}(f)-\\ \sum_j G_j^{BTEC}(f)H_{l,j}^{BTEC}(f)\end{array}\right)\right\|^p+\alpha\left\|\begin{array}{c}\sum_i G_i^{IEC}(f)H_{FB,i}^{IEC}(f)+\\ \sum_j G_j^{BTEC}(f)H_{FB,j}^{BTEC}(f)\end{array}\right\|^p\right)$$

Further, in one or more selected frequency ranges, only magnitude of the transfer functions may be taken into account during minimization while phase is disregarded, i.e. in the one or more selected frequency range, the transfer function is substituted by its absolute value.

The target transfer function need not be defined by the HRTF for the various directions l. Any transfer function that includes spatial cues may be used as the target transfer function.

For example, one of the ITE microphones of the at least one ITE microphone may be positioned at a position with relation to the user wherein the transfer function of the ITE microphone approximates the HRTFs of the user so that $HRTF_l(f)$ in the minimization problems specified above may be substituted by the transfer function $H_{l,ref}^{ITEC}(f)$ of the ITE microphone in question:

$$\min_{G_i^{IEC}(f),G_i^{BTEC}(f)}\sum_{l=0}^{L-1}W(l)\left\|W(f)\left(\begin{array}{c}H_{l,ref}^{ITEC}(f)-\sum_{i\neq ref}G_i^{IEC}(f)H_{l,i}^{IEC}(f)-\\ \sum_j G_j^{BTEC}(f)H_{l,j}^{BTEC}(f)\end{array}\right)\right\|^p$$

subject to $$\frac{1}{\left|\sum_{i\neq ref}G_i^{IEC}(f)H_{FB,i}^{IEC}(f)+\sum_j G_j^{BTEC}(f)H_{FB,j}^{BTEC}(f)\right|}\geq MSG(f)$$

or $$\min_{G_i^{IEC}(f),G_j^{BTEC}(f)}\left(\sum_{l=0}^{L-1}W(l)\left\|W(f)\left(\begin{array}{c}H_{l,ref}^{ITEC}(f)-\\ \sum_{i\neq ref}G_i^{IEC}(f)H_{l,i}^{IEC}(f)-\\ \sum_j G_j^{BTEC}(f)H_{l,j}^{BTEC}(f)\end{array}\right)\right\|^p+\alpha\left\|\begin{array}{c}\sum_{i\neq ref}G_i^{IEC}(f)H_{FB,i}^{IEC}(f)+\\ \sum_j G_j^{BTEC}(f)H_{FB,j}^{BTEC}(f)\end{array}\right\|^p\right)$$

Figure 8:
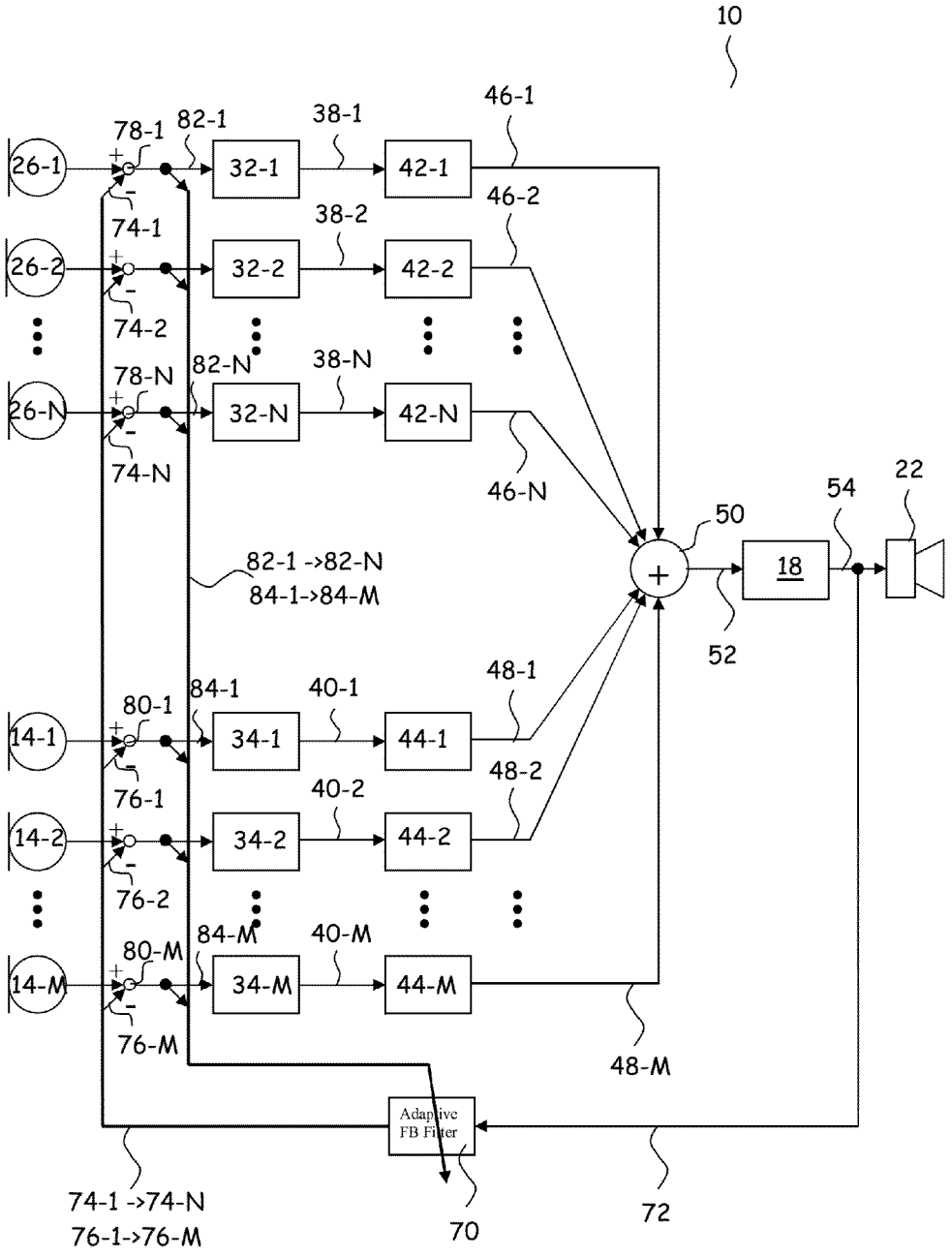
FIG. 8 shows a schematic block diagram of the new hearing aid of FIG. 7 with added feedback cancellation.

FIG. 8 is a block diagram illustrating a new hearing aid 10 similar to the hearing aid 10 shown in FIG. 7 except for the fact that an adaptive feedback canceller 70 has been added with an input 72 connected to the output of the processor 18 and outputs 74-1, 74-2, . . . , 74-N, 76-1, 76-2, . . . , 76-M connected to respective subtractors 78-1, 78-2, . . . , 78-N. 80-1, 80-2, . . . , 80-M for subtraction of the outputs from each respective microphone output audio signal to provide feedback compensated signals fed to the corresponding pre-processors 32-1, 32-2, . . . , 32-N, 34-1, 34-2, . . . , 34-M and to the feedback canceller 70 for control of the adaption of the feedback canceller 70 comprising adaptive filters as is well-known in the art. The feedback canceller 70 provide signals 74-1, 74-2, . . . , 74-N, 76-1, 76-2, . . . , 76-M that constitute approximations of corresponding feedback signals travelling from the output transducer 22 to the respective microphones 14-1, 14-2, . . . , 14-M, 26-1, 26-2, . . . , 26-N.

The hearing aid 10 shown in FIG. 8 may be a multi-channel hearing aid in which microphone output audio signals are divided into a plurality of frequency channels, and wherein divided signals are processed individually in each of the frequency channels.

For a multi-channel hearing aid 10, FIG. 8 may illustrate the circuitry and signal processing in a single frequency channel. The circuitry and signal processing may be duplicated in a plurality of the frequency channels, e.g. in all of the frequency channels. The adaptive feedback cancelling circuitry may also be divided into the plurality of frequency channels; or, the adaptive circuitry may still operate in the entire frequency range; or, may be divided into other frequency channels, typically fewer frequency channels, than the other circuitry is divided into.

For example, the signal processing illustrated in FIG. 8 may be performed in a selected frequency band, e.g. selected during fitting of the hearing aid 10 to a specific user at a dispenser's office.

The selected frequency band may comprise one or more of the frequency channels, or all of the frequency channels. The selected frequency band may be fragmented, i.e. the selected frequency band need not comprise consecutive frequency channels.

The plurality of frequency channels may include warped frequency channels, for example all of the frequency channels may be warped frequency channels.

Outside the selected frequency band, one or more of the at least one ITE microphone may be connected conventionally as an input source to the processor of the hearing aid and may cooperate with the processor of the hearing aid in a well-known way.

In this way, the one or more of the at least one ITE microphone provide the input to the processor 18 at frequencies where the hearing aid is capable of supplying the desired gain based on the input from the one or more of the at least one ITE microphone. In the selected frequency band, wherein the hearing aid cannot supply the desired gain with this configuration, the microphones of BTE hearing aid housing are included in the signal processing as disclosed above. In this way, the gain can be increased while simultaneously maintain the spatial information about the sound environment as provided by the array of microphones.

The transfer functions of the Cue filters 42-1, 42-2, . . . , 42-N, 44-1, 44-2, . . . , 44-M has been determined before use, e.g. at the dispenser's office, by the same steps as disclosed above in connection with FIG. 7.

Figure 9:
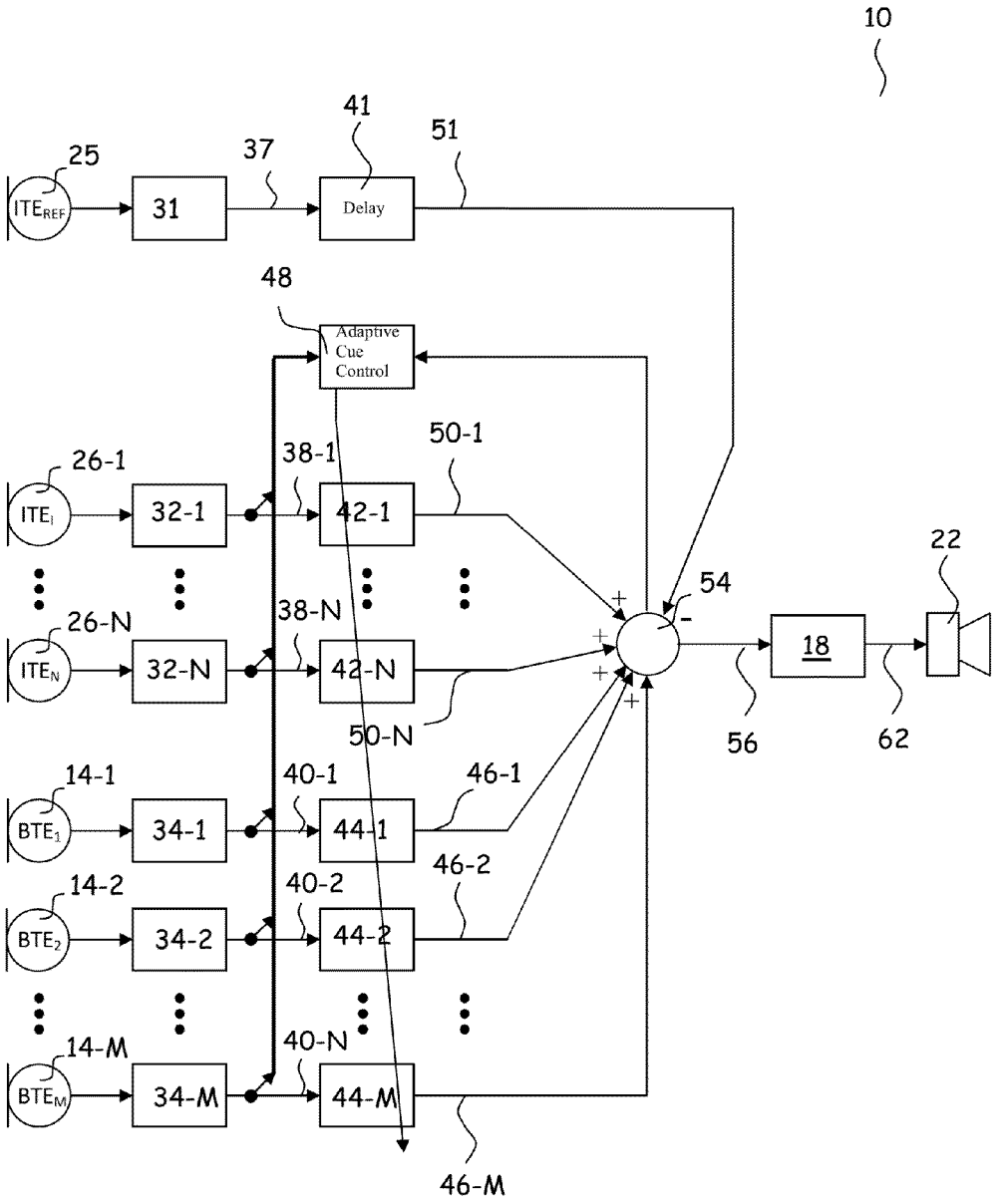
FIG. 9 shows a schematic block diagram illustrating one method of determining the cue filters.

FIG. 9 is a schematic block diagram illustrating one method of determining the cue filters 42-1, 42-2, . . . , 42-N, 44-1, 44-2, . . . , 44-M of the hearing aids shown in FIGS. 7 and 8, e.g. during fitting of the hearing aid.

The cue filters 42-1, 42-2, . . . , 42-N, 44-1, 44-2, . . . , 44-M are adaptive filters that are allowed to adapt during fitting of the hearing aid. After determination of the cue filters, the filter coefficients are kept constant at the respective determined values.

The microphone $ITE_{REF}$ 25 may be a single microphone located in a position with relation to an artificial head or a user with good preservation of spatial cues of incoming sound; or, the microphone $ITE_{REF}$ 25 may represent an array of microphones connected to pre-processor 31 and located in a position with relation to an artificial head or a user in which a combined signal output from the array of microphones, e.g. in cooperation with pre-processor 31, has good preservation of spatial cues of incoming sound.

Due to the positioning of microphone (array) $ITE_{REF}$ 25, the output signal of microphone (array) $ITE_{REF}$ 25 has a transfer function that constitutes a good approximation to the HRTFs of the user for one or more directions towards a sound source.

During fitting, various sound sources emit sound from respective various directions with relation to the artificial head or user of the hearing aid, and the cue filters 42-1, 42-2, . . . , 42-N, 44-1, 44-2, . . . , 44-M are allowed to adapt to the output signal 51 of the delay 41 and at the end of adaptation, e.g. when the filter coefficients of the cue filters 42-1, 42-2, . . . , 42-N, 44-1, 44-2, . . . , 44-M have stabilized, i.e. the changes of the filter coefficients have become less than a certain threshold, the filter coefficients are no longer allowed to change. Further, the signal 51 is disconnected from subtractor 54 so that signal 56 constitutes a combined output signal of the cue filters 42-1, 42-2, . . . , 42-N, 44-1, 44-2, . . . , 44-M that has substantially the same spatial cues as the output signal 51.

The delay 41 delays the output signal of the pre-processor 31 with a delay that is substantially equal to the delay of the cue filters 42-1, 42-2, . . . , 42-N, 44-1, . . . , 44-M.

During determination of the filter coefficients of the cue filters 42-1, 42-2, . . . , 42-N, 44-1, . . . , 44-M, e.g. during fitting, adaptation of the filter coefficients of the cue filters 42-1, 42-2, . . . , 42-N, 44-1, . . . , 44-M are controlled by adaptive cue controller 48 that controls the adaptation of the filter coefficients to minimize the output signal 52 of the subtractor 54 equal to the difference between sum of output signals 50-1, 50-2, . . . , 50-N, 46-1, 46-2, . . . , 46-M and the $ITE_{REF}$ microphone audio signal 51.

Thus, while adapting, the adaptive cue control 48 operates to adjust the filter coefficients of the cue filters 42-1, 42-2, . . . , 42-N, 44-1, 44-2, . . . , 44-M solving the following minimization problem:

$$\min_{G_i^{IEC}(f),G_i^{BTEC}(f)} \sum_{l=0}^{L-1} W(l) \left\| W(f) \left( H_{l,ref}^{ITEC}(f) - \sum_{i \neq ref} G_i^{IEC}(f) H_{l,i}^{IEC}(f) - \sum_j G_j^{BTEC}(f) H_{l,j}^{BTEC}(f) \right) \right\|^p$$

wherein

W(f) are frequency weights that may optimize the solution in certain one or more frequency ranges, and W(l) are angular weights that may optimize the solution for certain directions of arrival of sound.

W(f) may be equal to one for all frequencies and/or W(l) may be equal to one for all directions.

Possible feedback may be taken into account by solving the minimization problem above subject to the condition that $$\frac{1}{|\sum_i G_i^{IEC}(f) H_{FB,i}^{IEC} + \sum_j G_j^{BTEC}(f) H_{FB,j}^{BTEC}(f)|} \geq MSG(f)$$

or $$\min_{G_i^{IEC}(f),G_j^{BTEC}(f)} \left( \sum_{l=0}^{L-1} W(l) \left\| W(f) \left( HRTF_l(f) - \sum_i G_i^{IEC}(f) H_{l,i}^{IEC}(f) - \sum_j G_j^{BTEC}(f) H_{l,,j}^{BTEC}(f) \right) \right\|^p + \alpha \left\| \sum_i G_i^{IEC}(f) H_{FB,i}^{IEC}(f) + \sum_j G_j^{BTEC}(f) H_{FB,j}^{BTEC}(f) \right\|^p \right)$$

For example, the feedback compensation circuitry 72, 70, 74-1, 74-2, . . . , 74-N, 76-1, 76-2, . . . , 76-M, 78-1, 78-2, . . . , 78-N, 80-1, 80-2, . . . , 80-M, 82-1, 82-2, . . . , 82-N, 84-1, 84-2, . . . , 84-M, shown in FIG. 8 may be added to the circuit of FIG. 9 and in addition connecting the outputs 74-1, 74-2, . . . , 74-N, 76-1, 76-2, . . . , 76-M of the adaptive feedback filter 70 to respective inputs of the adaptive cue control 48, each of the outputs 74-1, 74-2, . . . , 74-N, 76-1, 76-2, . . . , 76-M providing an estimate of the hearing aid related transfer function of the respective at least one ITE microphone $H_{l,i}^{ITEC}(l)$ and the hearing aid related transfer functions of the respective at least one BTE microphone $H_{l,j}^{BTEC}(f)$ so that the adaptive cue control 48 can check the condition:

$$\frac{1}{|\sum_i G_i^{IEC}(f) H_{FB,i}^{IEC}(f) + \sum_j G_j^{BTEC}(f) H_{FB,j}^{BTEC}|} \geq MSG(f)$$

or solve the minimization problem:

$$\min_{G_i^{IEC}(f),G_j^{BTEC}(f)} \left( \sum_{l=0}^{L-1} W(l) \left\| W(f) \left( HRTF_l(f) - \sum_i G_i^{IEC}(f) H_{l,i}^{IEC}(f) - \sum_j G_j^{BTEC}(f) H_{l,,j}^{BTEC}(f) \right) \right\|^p + \alpha \left\| \sum_i G_i^{IEC}(f) H_{FB,i}^{IEC}(f) + \sum_j G_j^{BTEC}(f) H_{FB,j}^{BTEC}(f) \right\|^p \right)$$

Although particular embodiments have been shown and described, it will be understood that it is not intended to limit the claimed inventions to the preferred embodiments, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A method of determining parameters of a behind-the-ear (BTE) hearing aid having at least one in-the-ear (ITE) microphone and at least one BTE microphone, the method comprising:

determining transfer functions that include spatial cues;

determining a hearing aid related transfer function $H_{l,i}^{IEC}(f)$ of a $i^{th}$ microphone of the at least one ITE microphone for direction l;

determining a hearing aid related transfer functions $H_{l,j}^{BTEC}(f)$ of a $j^{th}$ microphone of the at least one BTE microphone;

determining transfer functions $G_i^{IEC}(f)$ of a $i^{th}$ cue filter of at least one cue filter filtering audio sound signals of the at least one ITE microphone; and determining transfer functions $G_j^{BTEC}(f)$ of a $i^{th}$ cue filter of the at least one cue filter filtering audio sound signals of the at least one BTE microphone;

wherein the transfer functions $G_i^{IEC}(f)$ and the transfer functions $G_j^{BTEC}(f)$ are determined using a processing unit in the BTE hearing aid, the processing unit configured to solve a minimization problem based on the transfer functions that include the spatial cues, the hearing aid related transfer function $H_{l,i}^{IEC}(f)$, and the hearing aid related transfer function $H_{l,j}^{BTEC}(f)$.

2. The method according to claim 1, further comprising:

determining a transfer function $H_{FB,i}^{IEC}(f)$ of a feedback path associated with the $i^{th}$ microphone of the at least one ITE microphone; and determining a transfer function $H_{FB,j}^{BTEC}(f)$ of a feedback path associated with the $j^{th}$ microphone of the at least one BTE microphone.

3. The method according to claim 2, further comprising:

determining filter coefficients of the at least one cue filter associated with the at least one ITE microphone, and filter coefficients of the at least one cue filter associated with the at least one BTE microphone by solving:

$$\min_{G_i^{IEC}(f),G_j^{BTEC}(f)} \sum_{l=0}^{L-1} W(l) \left\| W(f) \begin{pmatrix} HRTF_l(f) - \\ \sum_i G_i^{IEC}(f) H_{l,i}^{IEC}(f) - \\ \sum_j G_j^{BTEC}(f) H_{l,j}^{BTEC}(f) \end{pmatrix} \right\|^p$$

subject to $$\frac{1}{|\sum_i G_i^{IEC}(f) H_{FB,i}^{IEC}(f) + \sum_j G_j^{BTEC}(f) H_{FB,j}^{BTEC}(f)|} \geq MSG(f).$$

wherein MSG(f) is a maximum stable gain, or by solving:

$$\min_{G_i^{IEC}(f),G_j^{BTEC}(f)} \left( \sum_{l=0}^{L-1} W(l) \left\| W(f) \begin{pmatrix} HRTF_l(f) - \\ \sum_i G_i^{IEC}(f) H_{l,i}^{IEC}(f) - \\ \sum_j G_j^{BTEC}(f) H_{l,j}^{BTEC}(f) \end{pmatrix} \right\|^p + \alpha \left\| \begin{matrix} \sum_i G_i^{IEC}(f) H_{FB,i}^{IEC}(f) + \\ \sum_j G_j^{BTEC}(f) H_{FB,j}^{BTEC}(f) \end{matrix} \right\|^p \right)$$

wherein α is a weighting factor balancing spatial cue accuracy and feedback performance, p is an integer, W(l) is angular weight(s), and W(f) is frequency weight(s).

4. The method according to claim 2, wherein the transfer functions that include spatial cues comprise Head-Related Transfer functions $HRTF_l(f)$; and wherein the Head-Related Transfer functions $HRTF_l(f)$ are determined using a hearing aid related transfer function $H_{l,ref}^{ITEC}(f)$, and wherein filter coefficients of the at least one cue filter filtering audio sound signals of the at least one ITE microphone, and filter coefficients of the at least one cue filter filtering audio sound signals of the at least one BTE microphone are determined by solving equation:

$$\min_{G_i^{IEC}(f),G_i^{BTEC}(f)} \sum_{l=0}^{L-1} W(l) \left\| W(f) \begin{pmatrix} H_{l,ref}^{ITEC}(f) - \\ \sum_{i \neq ref} G_i^{IEC}(f) H_{l,i}^{IEC}(f) - \\ \sum_j G_j^{BTEC}(f) H_{l,j}^{BTEC}(f) \end{pmatrix} \right\|^p$$

subject to $$\frac{1}{|\sum_{i \neq ref} G_i^{IEC}(f) H_{FB,i}^{IEC}(f) + \sum_j G_j^{BTEC}(f) H_{FB,j}^{BTEC}(f)|} \geq MSG(f)$$

wherein MSG(f) is a maximum stable gain, p is an integer, W(l) is angular weight(s), and W(f) is frequency weight(s).

5. The method according to claim 2, wherein the transfer functions that include spatial cues comprise Head-Related Transfer functions $HRTF_l(f)$; and wherein the Head-Related Transfer functions $HRTF_l(f)$ are determined using a hearing aid related transfer function $H_{l,ref}^{ITEC}(f)$, and wherein filter coefficients of the at least one cue filter filtering audio sound signals of the at least one ITE microphone, and filter coefficients of the at least one cue filter filtering audio sound signals of the at least one BTE microphone are determined by solving equation:

$$\min_{G_i^{IEC}(f),G_j^{BTEC}(f)} \left( \sum_{l=0}^{L-1} W(l) \left\| W(f) \begin{pmatrix} H_{l,ref}^{ITEC}(f) - \\ \sum_{i \neq ref} G_i^{IEC}(f) H_{l,i}^{IEC}(f) - \\ \sum_j G_j^{BTEC}(f) H_{l,j}^{BTEC}(f) \end{pmatrix} \right\|^p + \alpha \left\| \begin{matrix} \sum_{i \neq ref} G_i^{IEC}(f) H_{FB,i}^{IEC}(f) + \\ \sum_j G_j^{BTEC}(f) H_{FB,j}^{BTEC}(f) \end{matrix} \right\|^p \right)$$

wherein $\alpha$ is a weighting factor balancing spatial cue accuracy and feedback performance, p is an integer, W(l) is angular weight(s), and W(f) is frequency weight(s).

6. The method according to claim 1, wherein the transfer functions that include spatial cues comprise Head-Related Transfer functions $HRTF_l(f)$; and wherein the acts of determining the Head-Related Transfer functions $HRTF_l(f)$, the hearing aid related transfer function $H_{l,i}^{IEC}(f)$, and the hearing aid related transfer functions $H_{l,i}^{BTEC}(f)$ are performed with the hearing aid mounted on an artificial head.

7. The method according to claim 1, wherein the transfer functions that include spatial cues comprise Head-Related Transfer functions $HRTF_l(f)$; and wherein the acts of determining the Head-Related Transfer functions $HRTF_l(f)$, the hearing aid related transfer function $H_{l,i}^{IEC}(f)$, and the hearing aid related transfer functions $H_{l,i}^{BTEC}(f)$ are performed for a number of users; and wherein filter coefficients of the at least one cue filter filtering audio sound signals of the at least one BTE microphone are determined based on an average value of the Head-Related Transfer functions $HRTF_l(f)$, an average value of the hearing aid related transfer function $H_{l,i}^{ITEC}(f)$, and an average value of the hearing aid related transfer functions $H_{l,i}^{BTEC}(f)$, of the number of users.

8. The method according to claim 1, wherein the hearing aid has a plurality of frequency channels; and wherein filter coefficients of the at least one cue filter filtering audio sound signals of the at least one ITE microphone, and filter coefficients of the at least one cue filter filtering audio sound signals of the at least one BTE microphone are determined in one or more of the frequency channels.

9. The method according to claim 8, further comprising disconnecting the at least one BTE microphone in one or more of the frequency channels so that hearing loss compensation is performed solely on an output of the at least one ITE microphone.

10. The method according to claim 1, further comprising generating a hearing loss compensated output signal based on a combination of filtered audio sound signals output by the at least one cue filter filtering audio sound signals of the at least one ITE microphone, or by the at least one cue filter filtering audio sound signals of the at least one BTE microphone, or by both.

11. The method according to claim 1, wherein the transfer functions that include spatial cues comprise Head-Related Transfer functions $HRTF_l(f)$ and the minimization problem is based on the equation:

$$\min_{G_i^{IEC}(f),G_i^{BTEC}(f)} \sum_{l=0}^{L-1} W(l) \left\| W(f) \left( \begin{array}{c} HRTF_l(f) - \\ \sum_i G_i^{IEC}(f) H_{l,i}^{IEC}(f) - \\ \sum_j G_j^{BTEC}(f) H_{l,j}^{BTEC}(f) \end{array} \right) \right\|^p$$

wherein

W(l) is an angular weighting factor,

W(f) is a frequency dependent weighting factor, and p is a positive integer.

12. The method according to claim 11, wherein W(l)=1.

13. The method according to claim 11, wherein W(f)=1.

14. The method according to claim 11, wherein p=2.

15. An apparatus for determining parameters of a behind-the-ear (BTE) hearing aid having at least one in-the-ear (ITE) microphone and at least one BTE microphone, the apparatus comprising a processing unit, wherein the processing unit comprises at least some hardware and is configured for:

determining transfer functions that include spatial cues;

determining a hearing aid related transfer function $H_{l,i}^{IEC}(f)$ of a $i^{th}$ microphone of the at least one ITE microphone for direction l;

determining a hearing aid related transfer functions $H_{l,j}^{BTEC}(f)$ of a $j^{th}$ microphone of the at least one BTE microphone;

determining transfer functions $G_i^{IEC}(f)$ of a $i^{th}$ cue filter of at least one cue filter filtering audio sound signals of the at least one ITE microphone; and determining transfer functions $G_j^{BTEC}(f)$ of a $j^{th}$ cue filter of the at least one cue filter filtering audio sound signals of the at least one BTE microphone;

wherein the processing unit is configured for determining the transfer functions $G_i^{IEC}(f)$ and the transfer functions $G_j^{BTEC}(f)$ by solving a minimization problem based on the transfer functions that include the spatial cues, the hearing aid related transfer function $H_{l,i}^{IEC}(f)$, and the hearing aid related transfer function $H_{l,j}^{BTEC}(f)$.

16. The apparatus according to claim 15, wherein the processing unit is further configured for:

determining a transfer function $H_{FB,i}^{IEC}(f)$ of a feedback path associated with the $i^{th}$ microphone of the at least one ITE microphone; and determining a transfer function $H_{FB,j}^{BTEC}(f)$ of a feedback path associated with the $j^{th}$ microphone of the at least one BTE microphone.

17. The apparatus according to claim 16, wherein the processing unit is further configured for:

determining filter coefficients of the at least one cue filter associated with the at least one ITE microphone, and filter coefficients of the at least one cue filter associated with the at least one BTE microphone by solving:

$$\min_{G_i^{IEC}(f),G_i^{BTEC}(f)} \sum_{l=0}^{L-1} W(l) \left\| W(f) \left( \begin{array}{c} HRTF_l(f) - \\ \sum_i G_i^{IEC}(f) H_{l,i}^{IEC}(f) - \\ \sum_j G_j^{BTEC}(f) H_{l,j}^{BTEC}(f) \end{array} \right) \right\|^p$$

subject to $$\frac{1}{\left|\sum_i G_i^{IEC}(f) H_{FB,i}^{IEC}(f) + \sum_j G_j^{BTEC}(f) H_{FB,j}^{BTEC}(f)\right|} \geq MSG(f)$$

wherein MSG(f) is a maximum stable gain, or by solving:

$$\min_{G_i^{IEC}(f),G_j^{BTEC}(f)}\left(\sum_{l=0}^{L-1}\left\|W(f)\left(\begin{array}{c}HRTF_l(f)-\\ \sum_i G_i^{IEC}(f)H_{l,i}^{IEC}(f)-\\ \sum_j G_j^{BTEC}(f)H_{l,j}^{BTEC}(f)\end{array}\right)\right\|^p+\alpha\left\|\begin{array}{c}\sum_i G_i^{IEC}(f)H_{FB,i}^{IEC}(f)+\\ \sum_j G_j^{BTEC}(f)H_{FB,j}^{BTEC}(f)\end{array}\right\|^p\right)$$

wherein α is a weighting factor balancing spatial cue accuracy and feedback performance, p is an integer, W(l) is angular weight(s), and W(f) is frequency weight(s).

18. The apparatus according to claim 16, wherein the transfer functions that include spatial cues comprise Head-Related Transfer functions $HRTF_l(f)$; and wherein the Head-Related Transfer functions $HRTF_l(f)$ are based on a hearing aid related transfer function $H_{l,ref}^{ITEC}(f)$, and wherein the processing unit is configured to determine filter coefficients of the at least one cue filter filtering audio sound signals of the at least one ITE microphone, and filter coefficients of the at least one cue filter filtering audio sound signals of the at least one BTE microphone by solving equation:

$$\min_{G_i^{IEC}(f),G_i^{BTEC}(f)}\sum_{l=0}^{L-1}W(l)\left\|W(f)\left(\begin{array}{c}H_{l,ref}^{ITEC}(f)-\\ \sum_{i\neq ref} G_i^{IEC}(f)H_{l,i}^{IEC}(f)-\\ \sum_j G_j^{BTEC}(f)H_{l,j}^{BTEC}(f)\end{array}\right)\right\|^p$$

subject to $$\frac{1}{\left|\sum_{i\neq ref} G_i^{IEC}(f)H_{FB,i}^{IEC}(f)+\sum_j G_j^{BTEC}(f)H_{FB,j}^{BTEC}(f)\right|}\geq MSG(f)$$

wherein MSG(f) is a maximum stable gain, p is an integer, W(l) is angular weight(s), and W(f) is frequency weight(s).

19. The apparatus according to claim 16, wherein the transfer functions that include spatial cues comprise Head-Related Transfer functions $HRTF_l(f)$; and wherein the Head-Related Transfer functions $HRTF_l(f)$ are based on a hearing aid related transfer function $H_{l,ref}^{ITEC}(f)$, and wherein the processing unit is configured to determine filter coefficients of the at least one cue filter filtering audio sound signals of the at least one ITE microphone, and filter coefficients of the at least one cue filter filtering audio sound signals of the at least one BTE microphone by solving equation:

$$\min_{G_i^{IEC}(f),G_j^{BTEC}(f)}\left(\sum_{l=0}^{L-1}W(l)\left\|W(f)\left(\begin{array}{c}H_{l,ref}^{ITEC}(f)-\\ \sum_{i\neq ref} G_i^{IEC}(f)H_{l,i}^{IEC}(f)-\\ \sum_j G_j^{BTEC}(f)H_{l,j}^{BTEC}(f)\end{array}\right)\right\|^p+\alpha\left\|\sum_{i\neq ref} G_i^{IEC}(f)H_{FB,i}^{IEC}(f)+\sum_j G_j^{BTEC}(f)H_{FB,j}^{BTEC}(f)\right\|^p\right)$$

wherein α is a weighting factor balancing spatial cue accuracy and feedback performance, p is an integer, W(l) is angular weight(s), and W(f) is frequency weight(s).

20. The apparatus according to claim 15, wherein the transfer functions that include spatial cues comprise Head-Related Transfer functions $HRTF_l(f)$; and wherein the processing unit is configured for determining the Head-Related Transfer functions $HRTF_l(f)$, the hearing aid related transfer function $H_{l,i}^{IEC}(f)$, and the hearing aid related transfer functions $HRTF_{l,i}^{BTEC}(f)$ with the hearing aid mounted on an artificial head.

21. The apparatus according to claim 15, wherein the transfer functions that include spatial cues comprise Head-Related Transfer functions $HRTF_l(f)$ and wherein the processing unit is configured for determining the Head-Related Transfer functions $HRTF_l(f)$, the hearing aid related transfer function $H_{l,i}^{IEC}(f)$, and the hearing aid related transfer functions $H_{l,i}^{BTEC}(f)$ for a number of users; and wherein the processing unit is configured to determine filter coefficients of the at least one cue filter filtering audio sound signals of the at least one BTE microphone based on an average value of the Head-Related Transfer functions $HRTF_l(f)$, an average value of the hearing aid related transfer function $H_{l,i}^{ITEC}(f)$, and an average value of the hearing aid related transfer functions $H_{l,i}^{BTEC}(f)$, of the number of users.

22. The apparatus according to claim 15, wherein the BTE hearing aid has a plurality of frequency channels; and wherein the processing unit is configured for determining filter coefficients of the at least one cue filter filtering audio sound signals of the at least one ITE microphone, and filter coefficients of the at least one cue filter filtering audio sound signals of the at least one BTE microphone, in one or more of the frequency channels.

23. The apparatus according to claim 22, wherein the processing unit is further configured for disconnecting the at least one BTE microphone in one or more of the frequency channels so that hearing loss compensation is performed solely on an output of the at least one ITE microphone.

24. The apparatus according to claim 15, wherein the processing unit is further configured for generating a hearing loss compensated output signal based on a combination of filtered audio sound signals output by the at least one cue filter filtering audio sound signals of the at least one ITE microphone, or by the at least one cue filter filtering audio sound signals of the at least one BTE microphone, or by both.

25. The apparatus according to claim 15, wherein the transfer functions that include spatial cues comprise Head-Related Transfer functions $HRTF_l(f)$ and the minimization problem is based on the equation:

$$\min_{G_i^{IEC}(f),G_i^{BTEC}(f)} \sum_{l=0}^{L-1} W(l) \left\| W(f) \left( \begin{array}{c} HRTF_l(f) - \\ \sum_i G_i^{IEC}(f) H_{l,i}^{IEC}(f) - \\ \sum_j G_j^{BTEC}(f) H_{l,j}^{BTEC}(f) \end{array} \right) \right\|^p$$

wherein

W(l) is an angular weighting factor,

W(f) is a frequency dependent weighting factor, and p is a positive integer.

26. The apparatus according to claim 25, wherein W(l)=1.

27. The apparatus according to claim 25, wherein W(f)=1.

28. The apparatus according to claim 25, wherein p=2.

* * * * *